US007310489B2

(12) United States Patent
Kawai

(10) Patent No.: US 7,310,489 B2
(45) Date of Patent: Dec. 18, 2007

(54) PROCESS CARTRIDGE INCLUDING FIRST AND SECOND PORTIONS TO BE POSITIONED AND FIRST AND SECOND PORTIONS TO BE SUPPORTED AND IMAGE FORMING APPARATUS DETACHABLY MOUNTING SUCH PROCESS CARTRIDGE

(75) Inventor: Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 11/094,317

(22) Filed: Mar. 31, 2005

(65) Prior Publication Data

US 2006/0216062 A1 Sep. 28, 2006

(30) Foreign Application Priority Data

Mar. 28, 2005 (JP) ..... 2005-091569

(51) Int. Cl.
*G03G 21/16* (2006.01)

(52) U.S. Cl. ..... 399/111; 399/114; 399/262

(58) Field of Classification Search ..... 399/111, 399/262, 112, 113, 114, 117, 167
See application file for complete search history.

(56) References Cited

U.S. PATENT DOCUMENTS

| | | | | |
|---|---|---|---|---|
| 4,839,690 | A | 6/1989 | Onoda et al. | 355/211 |
| 4,975,744 | A | 12/1990 | Ebata et al. | 355/211 |
| 5,023,660 | A | 6/1991 | Ebata et al. | 355/200 |
| 5,903,803 | A | 5/1999 | Kawai et al. | 399/116 |
| 5,940,657 | A | 8/1999 | Yokomori et al. | 399/119 |
| 5,950,049 | A | 9/1999 | Yokomori et al. | 399/119 |
| 6,055,406 | A | 4/2000 | Kawai et al. | 399/360 |
| 6,072,969 | A | 6/2000 | Yokomori et al. | 399/119 |
| 6,115,567 | A | 9/2000 | Kawai et al. | 399/106 |
| 6,128,454 | A | 10/2000 | Kawai et al. | 399/116 |
| 6,163,665 | A | 12/2000 | Watanabe et al. | 399/111 |
| 6,175,706 | B1 | 1/2001 | Watanabe et al. | 399/167 |
| 6,226,478 | B1 | 5/2001 | Watanabe et al. | 399/117 |
| 6,240,266 | B1 | 5/2001 | Watanabe et al. | 399/117 |
| 6,336,018 | B1 | 1/2002 | Kawai et al. | 399/117 |

(Continued)

FOREIGN PATENT DOCUMENTS

JP 62-65049 A 3/1987

(Continued)

*Primary Examiner*—David M. Ghay
*Assistant Examiner*—Laura K Roth
(74) *Attorney, Agent, or Firm*—Fitzpatrick, Cella, Harper & Scinto

(57) ABSTRACT

A process cartridge detachably mountable to a main assembly of an electrophotographic image forming apparatus. The cartridge includes an electrophotographic photosensitive drum, a developing roller, a drum unit for rotatably supporting the drum, first and second portions to be positioned relative to the main assembly, a rotatable developing unit, and first and second portions to be supported on first and second supporting portions to permit a rotation of the developing unit in the crossing direction when the process cartridge is set in the main assembly of the apparatus, and a driving force receiving member, rotatably supported on an outer surface of the second portion to be supported, for receiving a driving force for rotating the developing roller from a driving force transmission member provided in the main assembly when the process cartridge is set in the main assembly of the apparatus.

26 Claims, 14 Drawing Sheets

U.S. PATENT DOCUMENTS

| | | | | |
|---|---|---|---|---|
| 6,349,188 | B1 | 2/2002 | Kawai et al. | 399/116 |
| 6,381,430 | B1 | 4/2002 | Yokomori et al. | 399/119 |
| 6,463,232 | B1 | 10/2002 | Kawai et al. | 399/111 |
| 6,480,687 | B1 | 11/2002 | Kawai et al. | 399/111 |
| 6,496,667 | B2 | 12/2002 | Shiratori et al. | 399/103 |
| 6,501,926 | B1 | 12/2002 | Watanabe et al. | 399/117 |
| 6,501,927 | B1 | 12/2002 | Watanabe et al. | 399/117 |
| 6,560,422 | B2 | 5/2003 | Kanno et al. | 399/106 |
| 6,735,403 | B2 | 5/2004 | Kanno et al. | 399/103 |
| 6,738,588 | B2 | 5/2004 | Yokomori et al. | 399/111 |
| 6,947,686 | B2 | 9/2005 | Kawai et al. | 399/111 |
| 6,968,142 | B2 | 11/2005 | Arimitsu et al. | 399/114 |
| 7,016,626 | B2 | 3/2006 | Yokomori et al. | 399/117 |
| 7,027,754 | B2 | 4/2006 | Harada et al. | 399/111 |
| 7,046,942 | B2 | 5/2006 | Arimitsu et al. | 399/114 |
| 2002/0051653 | A1* | 5/2002 | Toba et al. | 399/111 |
| 2003/0156848 | A1 | 8/2003 | Kawai et al. | 399/27 |
| 2005/0191086 | A1 | 9/2005 | Kawai et al. | 399/110 |
| 2006/0045574 | A1 | 3/2006 | Kawai et al. | 399/254 |

FOREIGN PATENT DOCUMENTS

| | | | |
|---|---|---|---|
| JP | 02-282272 | A | 11/1990 |
| JP | 09-297443 | A | 11/1997 |
| JP | 2002-149038 | A | 5/2002 |

* cited by examiner

A-A

PROCESS CARTRIDGE INCLUDING FIRST AND SECOND PORTIONS TO BE POSITIONED AND FIRST AND SECOND PORTIONS TO BE SUPPORTED AND IMAGE FORMING APPARATUS DETACHABLY MOUNTING SUCH PROCESS CARTRIDGE

FIELD OF THE INVENTION AND RELATED ART

The present invention relates to an electrophotographic image forming apparatus and a process cartridge detachably mountable to a main assembly of the apparatus of the electrophotographic image forming apparatus.

Here, the electrophotographic image forming apparatus is an apparatus forming an image on a recording material (for example, plain paper, an OHP sheet or the like) using an electrophotographic image formation type operation. The electrophotographic image forming apparatus includes an electrophotographic copying machine, an electrophotographic printer (for example a laser beam printer, an LED printer or the like), a facsimile machine, a word processor and the like.

A process cartridge is known as a unit detachably demountable to a main assembly of the apparatus of the electrophotographic image forming apparatus, wherein the process cartridge contains an electrophotographic photosensitive drum, process means and a developing roller.

In the state that the cartridge is set in the main assembly of the apparatus, the cartridge is correctly positioned relative to the main assembly of the apparatus. When an image is formed on a recording material, a driving force for rotating the developing roller provided in the cartridge is transmitted from the main assembly of the apparatus to the cartridge.

The cartridge includes a developing unit having the developing roller and a drum unit having the photosensitive drum, which units are connected rotatably about a shaft. The cartridge is provided with a gear for receiving a driving force for rotating the developing roller from the main assembly of the apparatus.

A structure in which the shaft and the gear are disposed on an axis is known (Japanese Laid-open Patent Application 2002-149038).

With this structure, by selection of the disposition of the shaft and the gear, the load applied from the developing unit to the drum unit when the cartridge is set in the main assembly of the apparatus, is reduced. By doing so, the positioning accuracy of the cartridge relative to the main assembly of the apparatus when the cartridge is set in the main assembly of the apparatus, is improved. Because of the trend for high image quality, stabilization of the position of the cartridge relative to the main assembly of the apparatus is desired.

SUMMARY OF THE INVENTION

Accordingly, it is a principal object of the present invention to provide an image forming apparatus and a process cartridge wherein the process cartridge is positioned with high accuracy relative to the main assembly of the apparatus when the process cartridge is set in the main assembly of the electrophotographic image forming apparatus.

It is another object of the present invention to provide an image forming apparatus and a process cartridge wherein a driving force is transmitted stably from the main assembly of the apparatus to the developing roller provided in the cartridge when the process cartridge is set in the main assembly of the electrophotographic image forming apparatus.

It is a further object of the present invention to provide an image forming apparatus and a process cartridge wherein a load to the cartridge is reduced, when the driving force is transmitted from the main assembly of the apparatus to the developing roller provided in the cartridge when the process cartridge is set in the main assembly of the electrophotographic image forming apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, a cartridge, a developing cartridge and a process cartridge according to an embodiment of the present invention will be described.

First, a description will be provided as to a general arrangement of the electrophotographic image forming apparatus and a structure of the process cartridge.

(General Arrangement of Electrophotographic Image Forming Apparatus)

Figure 1:
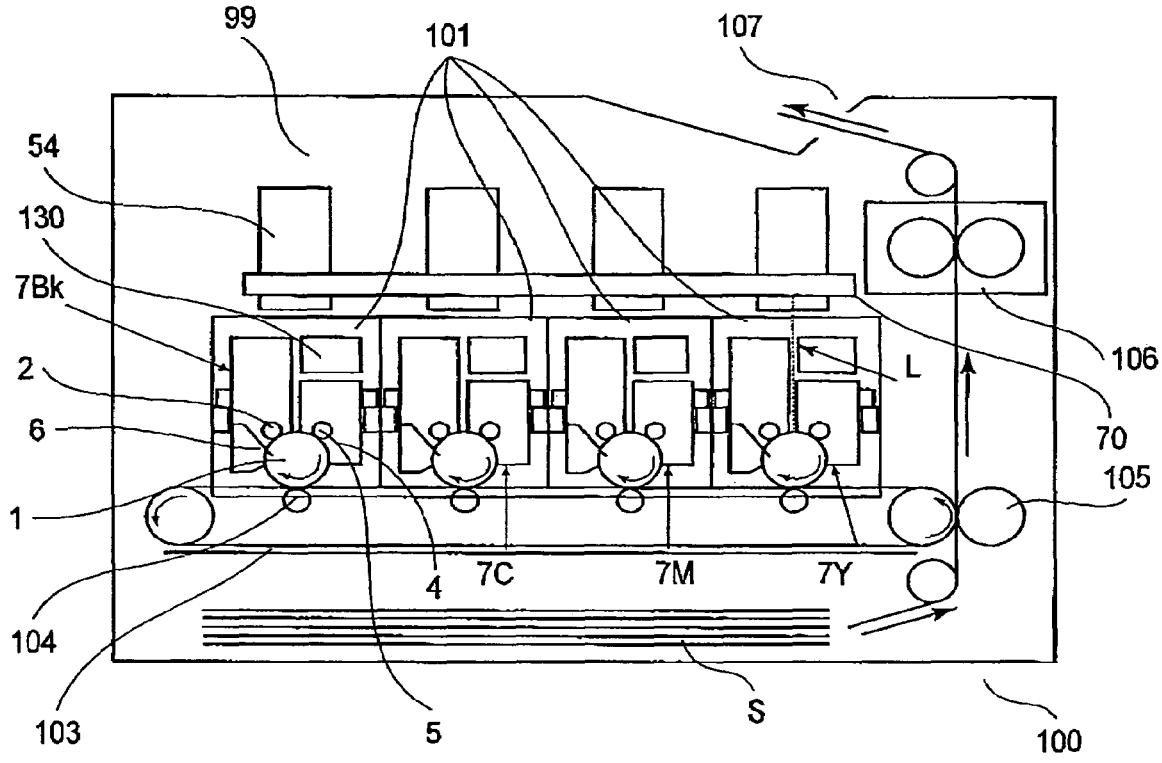
FIG. 1 is a sectional view of an electrophotographic image forming apparatus according to an embodiment of the present invention.
Figure 9:
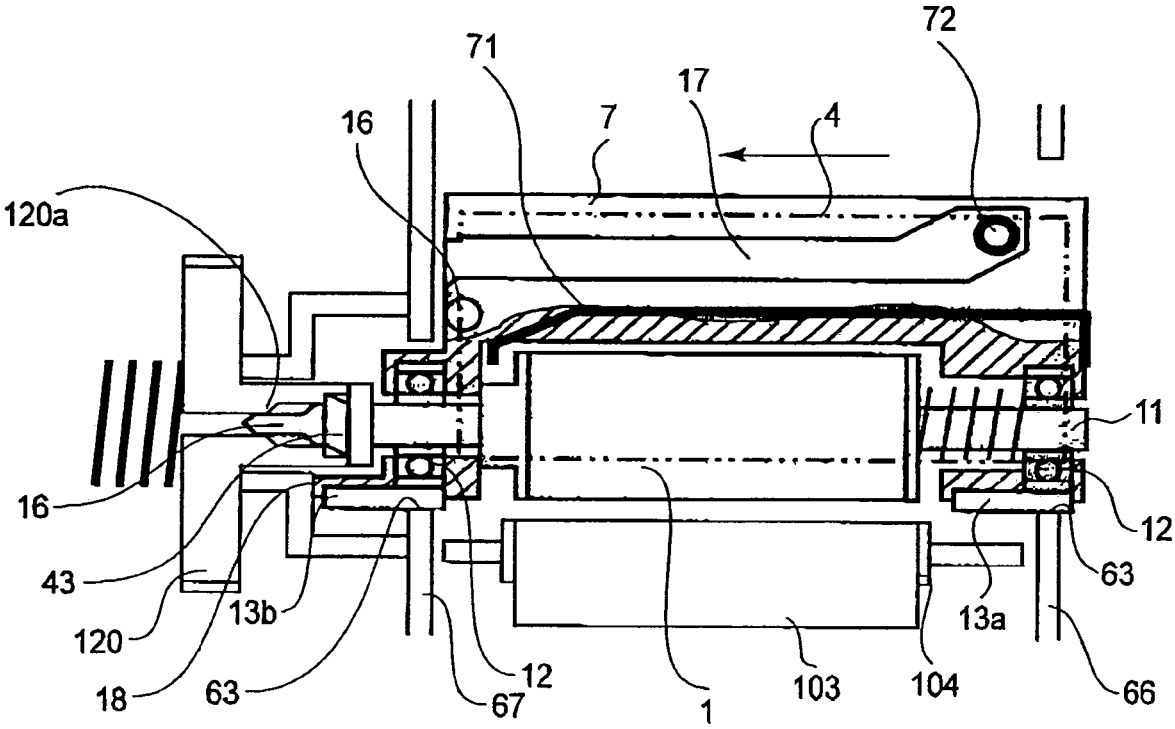
FIG. 9 is a side view showing a state in which the process cartridge has been completely set in the main assembly of the image forming apparatus.

Referring to FIG. 1, a description will be provided as to an electrophotographic image forming apparatus 100 to which a process cartridge 7 is detachably mountable, according to an embodiment of the present invention. The main assembly 99 of the image forming apparatus 100 is provided with four cartridge mounting portions 101 for detachably mounting cartridges 7 (7Y, 7M, 7C, 7Bk). The mounting portions 101 are arranged in parallel in the horizontal direction when the main assembly 99 of the apparatus is installed. Each of the cartridges 7 (7Y, 7M, 7C, 7Bk) has one electrophotographic photosensitive drum. A cartridge 7Y accommodates a yellow developer. A cartridge 7M accommodates a magenta developer. A cartridge 7C accommodates a cyan developer. A cartridge 7Bk accommodates a black developer. In this embodiment, the developer is a non-magnetic one component toner. The cartridges 7 are arranged in the order of 7Y, 7M, 7C and 7K in the direction from an upstream position toward a downstream position with respect to a direction of the image formation process, namely the direction indicated by an arrow inside rollers of a transfer belt 103 in the figure, that is, in the moving direction of a transfer belt 103 which will be described hereinafter. The photosensitive drum 1 rotates in the clockwise direction by a drive transmitting portion 120 shown in FIG. 9 provided in the main assembly 99 of the apparatus. Around the photosensitive drum 1, there are provided a charging roller 2, a scanner unit 54, a developing unit 4, the transfer belt 103 and cleaning means 6 in the order named with respect to the rotational direction thereof. The charging roller 2 is contacted to the photosensitive drum 1 to uniformly charge the peripheral surface of the photosensitive drum 1. The scanner unit projects a laser beam L onto the peripheral surface of the photosensitive drum 1 on the basis of image information. As a result, an electrostatic latent image is formed corresponding to the image information on the peripheral surface of the photosensitive drum 1. The developing unit 4 rotatably supports the developing roller 5. The developing roller 5 develops the electrostatic latent image with a developer. The transfer belt 103 is rotated while contacting to the photosensitive drum 1. A developed image provided on the photosensitive drum 1 by the developing means is electrostatically transferred onto the transfer belt 103. The cleaning means 6 removes the developer remaining on the peripheral surface of the photosensitive drum 1 after the image transfer. In this embodiment, the cleaning means is in the form of a cleaning blade. The photosensitive drum 1, the charging roller 2, the developing unit 4 and the cleaning means 6 are constituted into a unit (cartridge).

A primary transfer roller 104 is provided at a position opposed to the photosensitive drum 1 with the transfer belt 103 interposed therebetween. The primary transfer roller 104 urges the transfer belt 103 to the photosensitive drum 1. At a right-hand side in FIG. 1, the transfer belt 103 is disposed opposed to the transfer roller 105 and is contacted thereto. The recording material S passes through the contact portion where the transfer belt 103 is contacted to the secondary transfer roller 105. The developed image is transferred onto the recording material S from the transfer belt 103 at the contact portion.

(Operation of Image Formation).

The image forming operation will be described. The photosensitive drums 1 of the cartridges 7 are rotated at respective timings on the basis of image formation operations by a main assembly drive transmitting portion 120 provided in the main assembly 99 of the apparatus Initially, the developing roller 5 is separated from the photosensitive drum 1. However, the developing roller 5, while rotating, is brought into contact to the photosensitive drum 1 at a proper timing with the image formation. When a full-color image is to be formed, the contacting operations between the developing rollers 5 and the photosensitive drums 1 are carried out in the order of the cartridge 7Y, the cartridge 7M, the cartridge 7C and the cartridge 7Bk. When the full-color image forming operation is to be stopped, the separating operations between them are carried out in the same order. When a monochromatic image is to be formed, the contacting operation is effected only in the cartridge 78*k* at the start of image formation, and the separating operation is effected only in the cartridge 7Bk. Then, the scanner units are driven for the respective cartridges 7. The charging roller 2 is rotated by the rotation of the photosensitive drum 1. And, the charging roller 2 is supplied with a charging bias. As a result, the peripheral surface of the photosensitive drum 1 is uniformly charged electrically. The scanner unit projects a laser beam L in accordance with image information onto the peripheral surface of the photosensitive drum 1. By this, an electrostatic latent image is formed on the peripheral surface of the photosensitive drum 1. The developing roller 5 rotatably supported on the developing unit 4 develops the electrostatic latent image with a developer. By an electric field formed between each of the photosensitive drums 1 and their associated primary transfer roller 104, the developed image formed on the photosensitive drum 1 is sequentially transferred onto the transfer belt 103. Thereafter, the developed images of four colors thus transferred onto the transfer belt 103, is transferred onto the recording material S by an electric field formed between the transfer belt 103 and the secondary transfer roller 105. Then, the recording material S is fed into the fixing portion 106. In the fixing portion 106, the developed image is heat-fixed on the recording material S. Then, the recording material S is discharged to the outside of the image forming apparatus 100 through the discharging portion 107. The photosensitive drum 1 continues rotating with the developer remaining on the peripheral surface thereof after the image transfer. The remaining developer is removed from the photosensitive drum 1 by the cleaning means 6. In this manner, the photosensitive drum 1 becomes prepared for the next image forming process.

(Process Cartridge).

Figure 2:
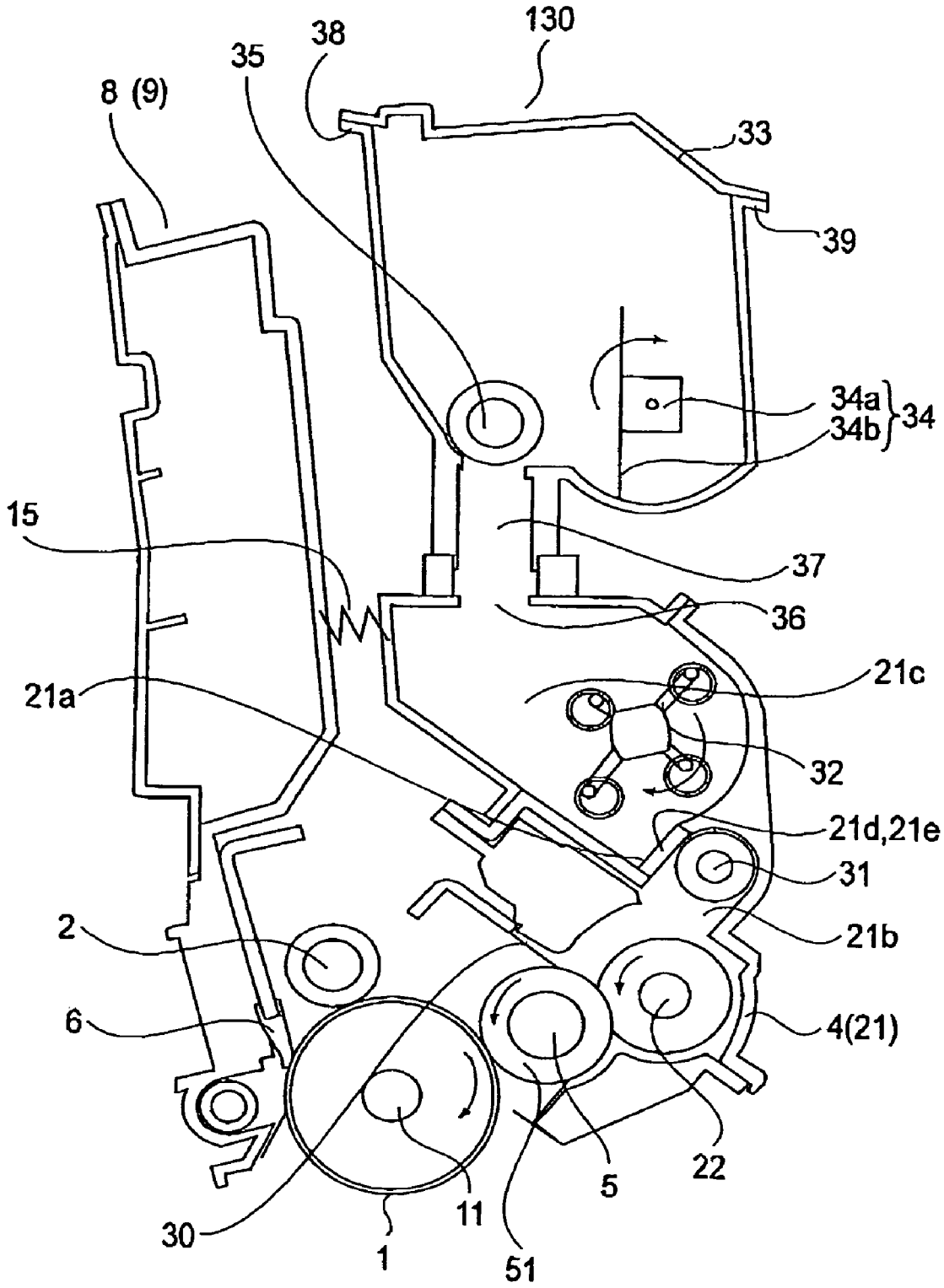
FIG. 2 is a sectional view of a process cartridge and a developer supply container.
Figure 3:
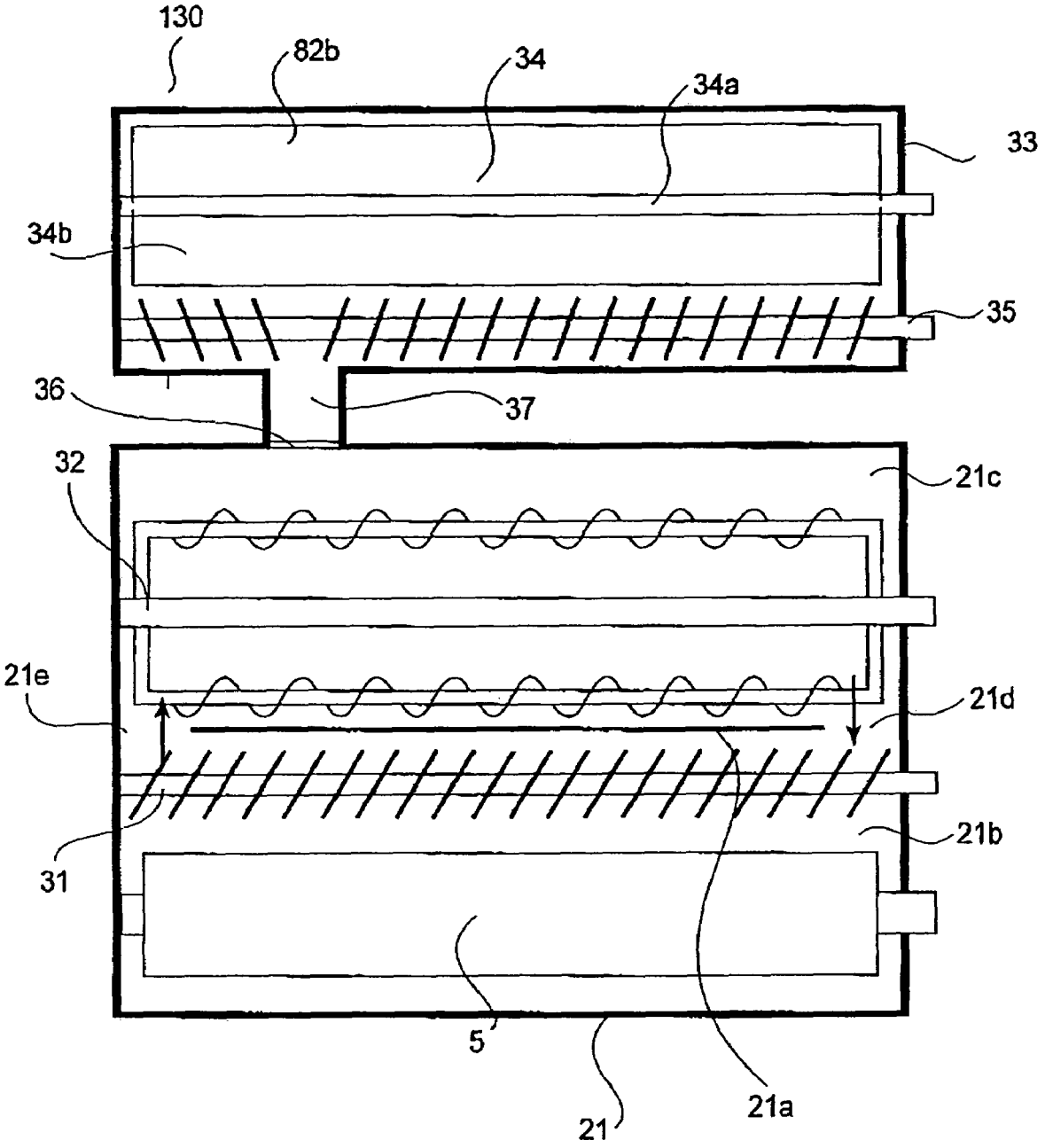
FIG. 3 is a lateral sectional view of a process cartridge and a developer supply container as seen laterally.

FIG. 2 is a sectional view of a process cartridge 7 according to an embodiment; FIG. 3 is a lateral sectional view of a developing unit 4 (rightward direction in FIG. 2). As shown in FIG. 2, the cartridge 7 includes a drum unit 8 and a developing unit 4.

The drum unit 8 has a drum frame 9 as a frame. The frame 9 rotatably supports the photosensitive drum 1. The frame 9 supports the charging roller 2 and the blade 6.

On the other hand, the developing unit 4 has a developing device frame 21 (frame). The frame 21 rotatably supports the developing roller 5. The developing roller 5 is rotatable in the counterclockwise direction as indicated by an arrow in FIG. 2. The frame 21 is provided with an opening. The opening is opposed to the photosensitive drum 1. A part of the developing roller 5 is exposed through the opening. The developing roller 5 is an elastic roller of a low hardness rubber material or a foam member such silicone, urethane or a combination thereof. The developing roller 5 has an elastic member 51. The elastic member 51 is contacted to the photosensitive drum 1 at a predetermined contact pressure. The developer supplying roller 22 functions to supply the developer to and collect the developer from the developing roller 5 and is made of an elastic sponge roller. The supplying roller 22 is disposed contacted to the developing roller 5.

The developing device frame 21 supports the developing blade 30 (developer layer thickness regulating member). In the embodiment, the blade 30 is a leaf spring of metal. The blade 30 is contacted to the developing roller 5 at a predetermined contact pressure. The developer supplied from the supplying roller 22 to the developing roller 5 is regulated in the amount deposited on the peripheral surface of the developing roller 5 and is triboelectrically charged. As a result, a thin layer of the developer is formed on the peripheral surface of the developing roller 5. The thin layer of the developer is fed to a developing zone where the developing roller 5 is opposed to the photosensitive drum 1. In the developing zone, the developer is supplied onto the photosensitive drum 1 from the developing roller 5 in accordance with the electrostatic latent image formed on the photosensitive drum 1.

The developer kept deposited on the developing roller 5 (not supplied to the photosensitive drum 1) is scraped off the developing roller 5 by the supplying roller 22. A part of the scraped developer is supplied again to the developing roller 5 together with the developer supplied newly to the supplying roller 22. The developer remaining despite the scraping is returned into the developer chamber 21*b*, which will be described hereinafter.

The frame 21 is divided into two chambers, namely, an upper chamber and a lower chamber, by a partition wall 21*a*. The lower chamber contains the developing roller 5 and has a screw 31 which will be described hereinafter, and functions as a developer chamber 21*b*. The upper chamber has a stirring member 32 which will be described hereinafter, and functions as a stirring chamber 21*c*. The developer chamber 21*b* and the stirring chamber 21*c* both contain the developer. The developer chamber 21*b* and the stirring chamber 21*c* are in fluid communication with each other through an opening 21*d* formed at one longitudinal end of the frame 21 and an opening 21*e* formed at the other longitudinal end.

In the developer chamber 21*b*, the screw 31 extends in the longitudinal direction and feeds the developer in the longitudinal direction. The screw 31 feeds the developer in the longitudinal direction in the developer chamber 21*b*. In other words, the screw 31 feeds the developer so that it falls through the opening 21*d* (inlet side) to the opening 21*e* (outlet side). Adjacent the opening 21*e* (outlet side), the screw 31 feeds the developer from the developer chamber 21*b* to the stirring chamber 21*c* by its feeding force (pressure).

The stirring chamber 21*c* has therein the rotatably supported stirring member 32. By rotation of the stirring member 32, the developer in the stirring chamber 21*c* is scooped and stirred.

The screw 31 and the stirring member 32 are connected with the developing roller 5 and the supplying roller 22 by a gear which will be described hereinafter. During image formation (while the developing roller 5 is being rotated), the screw 31 and the stirring member 32 are rotated. Upon the end of the image forming operation, the rotations of the screw 31 and the stirring member 32 stop.

In FIG. 2, an exposure opening 15 is formed between the drum unit 8 and the developing unit 4. The laser beam L emitted from the scanner unit 54 is projected on the photosensitive drum 1 through the opening 15. As a result, an electrostatic latent image is formed on the photosensitive drum 1.

(Developer Supply Container).

As shown in FIG. 1-FIG. 3, a developer supply container 130 is detachably mountable to the mounting portion 101 independently from the cartridge 7. The container 130 can be detachably mountable to the mounting portion 101 in the longitudinal direction. In the state that the cartridge 7 and the container 130 are mounted to the mounting portion 101, the container 130 is disposed above the developing unit 4.

The container 130 has a developer accommodating portion 33. The accommodating portion 33 accommodates the developer.

The container 130 includes a stirring member 34, a screw 35 and a developer supply opening 37. The stirring member 34 and the screw 35 are provided in the accommodating portion 33.

The stirring member 34 stirs the developer accommodated in the accommodating portion 33. The stirring member 34 includes a rotation shaft 34*a* (base), and a stirring plate 34*b* (flexible sheet (polyethylene terephthalate, for example)). The opposite longitudinal ends of the rotation shaft 34*a* are rotatably supported on an inner wall of the accommodating portion 33.

The screw 35 supplies the developer from the accommodating portion 33 into the cartridge 7 by the feeding force thereof. The screw 35 has a helical rib configuration. The longitudinal opposite ends of the screw 35 are rotatably supported on the inner wall of the accommodating portion 33.

The supply-opening 37 functions to supply the developer from the accommodating portion 33 into the stirring chamber 21*c*. The supply opening 37 takes a bottommost portion of the container 130 when the container 130 is set in the main assembly 99 of the apparatus. With such an arrangement, the developer capacity of the container 130 is maximized. The structures of the stirring member 34 and the screw 35 can be simplified.

On the other hand, the developing unit 4 has an opening 36 for receiving the developer. The receiving opening 36 is disposed above the developing unit 4 when the cartridge 7 is mounted to the main assembly 99 of the apparatus. The receiving opening 36 functions to guide the developer supplied through the supply opening 37 into the developing unit 4.

Figure 10:
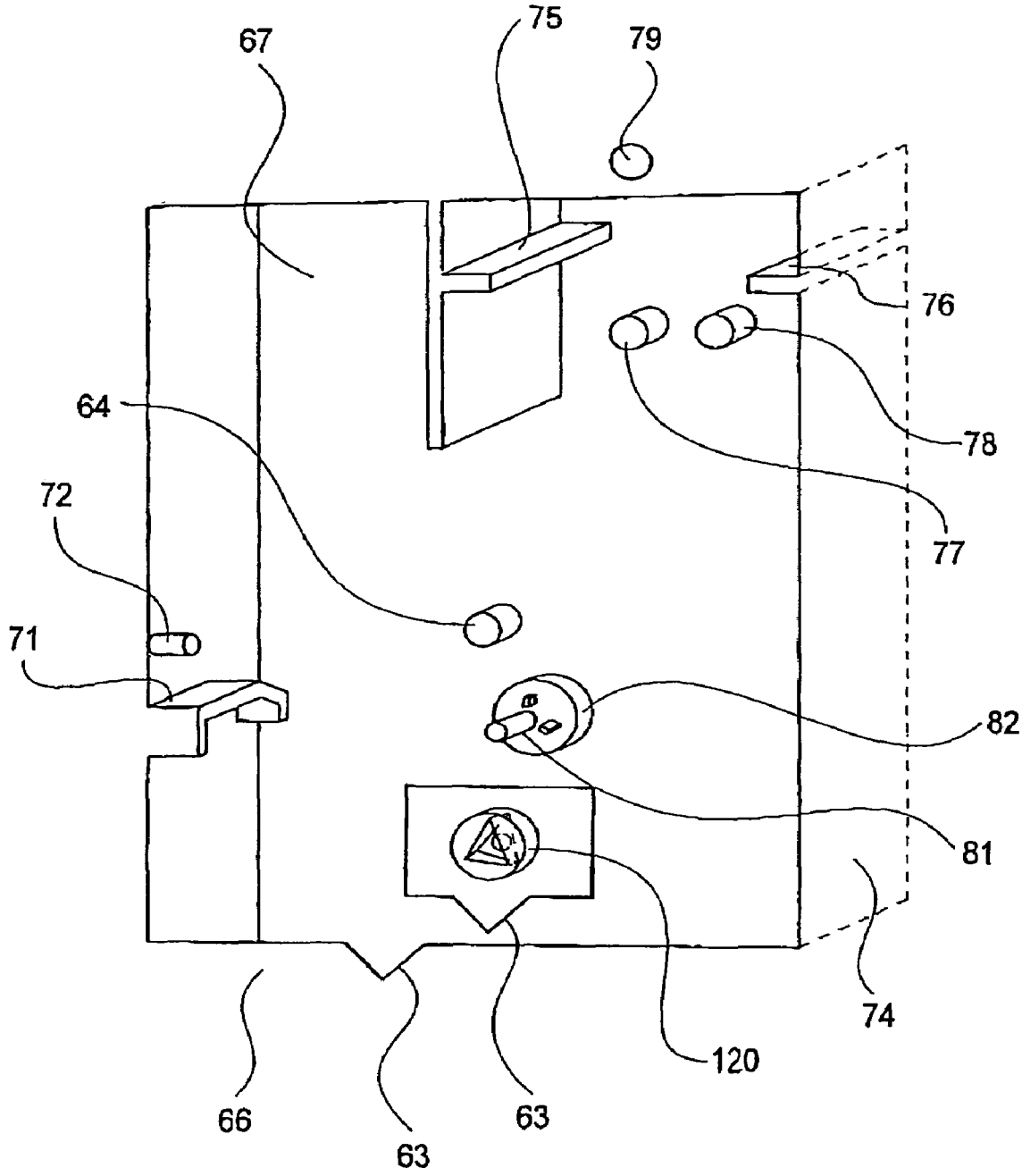
FIG. 10 is a perspective view illustrating a positioning portion of the electrophotographic image forming apparatus.
Figure 11:
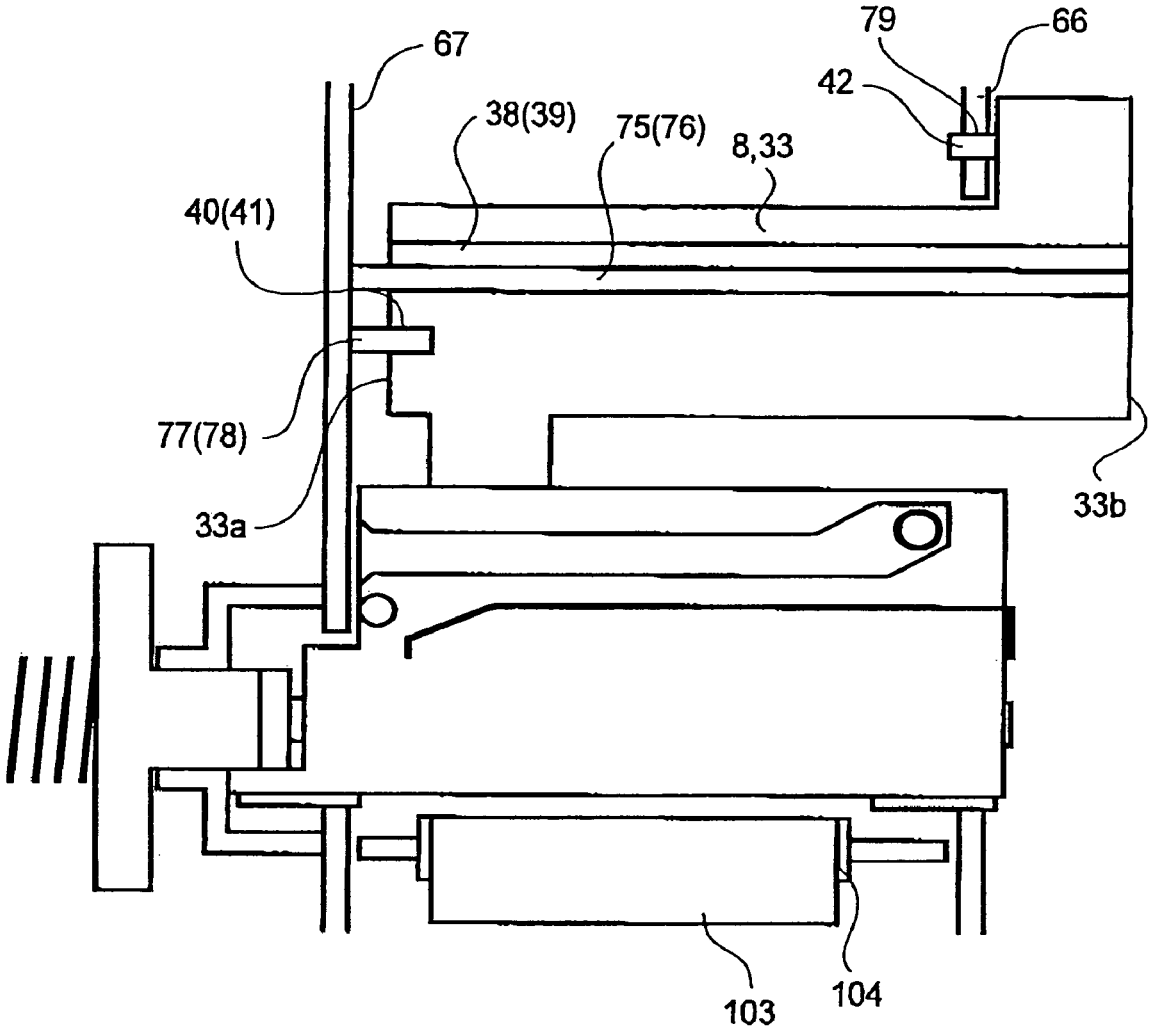
FIG. 11 is a side view illustrating a structure for positioning the developer supply container relative to the electrophotographic image forming apparatus.

As shown in FIG. 11, the container 130 is provided at one end with a first portion to be guided 38 and at the other end with a second portion to be guided 39, as seen in the mounting direction. As shown in FIGS. 10 and 11, the mounting portion 101 is provided at one end with a first guide portion 75 and at the other end with a second guide portion 76, as seen in the mounting direction. When the container 130 is mounted to the mounting portion 101, the guide portions 38, 39 guide the portions to be guided 75, 76, respectively. When the mounting is completed, recesses 40, 41 of the container 130 are positioned to projections 78, 77 of the mounting portion 101 at a rear portion with respect to the mounting direction. At the rear side with respect to the mounting direction, a projection 42 of the container 130 is positioned to the recess 79 of the mounting portion 101. When the cartridge 7 and the container 130 are mounted in the main assembly 99 of the apparatus, the supply opening 37 and the receiving opening 36 face each other. As a result, the supply of the developer from the container 130 to the developing unit 4 is enabled.

The main assembly 99 of the apparatus is provided with control means (unshown) to detect the amount of the developer in the developing unit 4. When the control means detects a shortage of the developer in the frame 21, the stirring member 34 and the screw 35 are rotated. In other words, when the control means determines the necessary of supply of the developer into the cartridge 7 from the container 130, the stirring member 34 and the screw 35 are rotated. Then, the developer is fed toward the supply opening 37. The developer falls from the supply opening 37 to the receiving port 36. In this manner, the amount of the developer in the developing unit 4 is kept substantially constant.

(Structure of Positioning of Process Cartridge)

Figure 4:
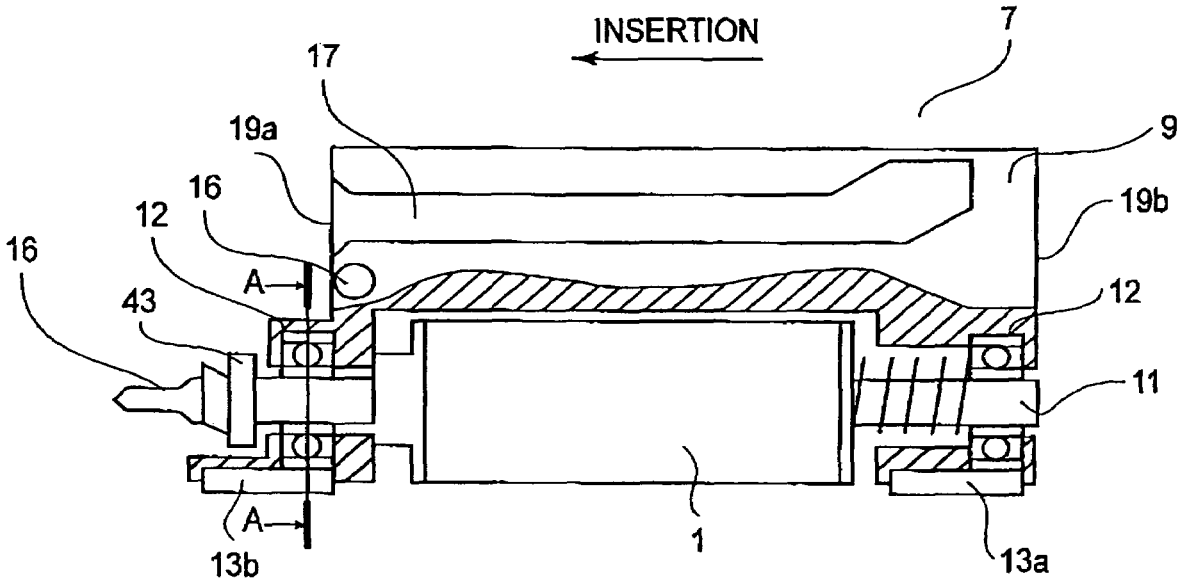
FIG. 4 is a side view of a process cartridge.

FIG. 4 is a sectional view of the process cartridge 7. In FIG. 4, the cartridge 7 is demountably mounted to the mounting portion 101 in the direction indicated by an arrow (the longitudinal direction of the cartridge 7, namely, the longitudinal direction of the developing roller 5 (photosensitive drum 1).

The drum frame 9 has a bearing 12 (supporting member for rotatably supporting the photosensitive drum 1). The bearing 12 is provided at each of one and the other longitudinal ends of the frame 9. On the other hand, the photosensitive drum 1 is integral with the drum shaft 11. The drum shaft 11 supports the photosensitive drum 1. The bearing 12 rotatably supports the longitudinal opposite ends of the drum shaft 11.

In the mounting direction, a first portion to be positioned 13*a* is disposed at the rear side of the frame 9. A second portion to be positioned 13*b* is provided at the front side of the frame 9. Each of the portions to be positioned 13 (13*a*, 13*b*) is positioned relative to the main assembly 99 of the apparatus with respect to the direction crossing the mounting direction of the cartridge 7. Each of the portions to be positioned 13 is supported on the frame 9 so as to be contacted to the outer periphery of the bearing 12. Each of the portions to be positioned 13 is disposed at a position ahead of the bearing 12 with respect to the mounting direction. Each of the portions to be positioned 13 is an elongated metal pin.

Figure 5:
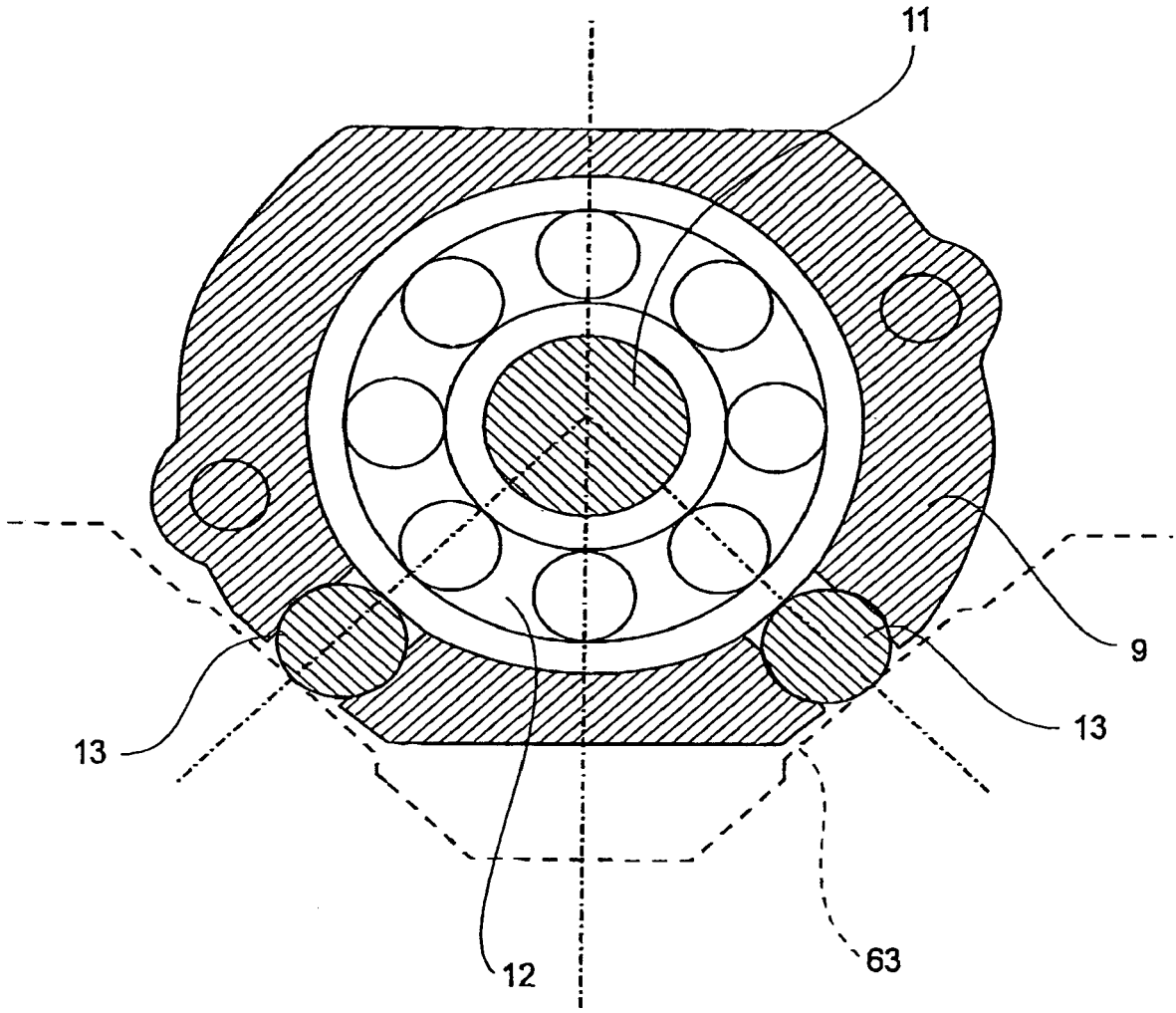
FIG. 5 is a sectional view of structures around a bearing.

FIG. 5 is a view of the bearing 12 and the portions to be positioned 13 as seen in the mounting direction. As shown in FIG. 5, the portion to be positioned 13 (13*a*, 13*b*) is provided at each of two positions on a lower surface of the outer periphery of the bearing 12 as seen in the mounting direction. The two portions to be positioned 13 are disposed equidistantly from a vertical line passing through the center of the bearing 12. The portions to be positioned 13 are extended in parallel along the longitudinal direction of the photosensitive drum 1. The portions to be positioned 13 are extended in parallel with the axis of the photosensitive drum 1. The portions to be positioned 13 are integral with the bearing 12. When the cartridge 7 is mounted to the main assembly 99 of the apparatus, the cartridge 7 is positioned to the main assembly 99 of the apparatus while aligning the photosensitive drum 1. With respect to the radial direction of the bearing 12, the portion to be positioned 13 is loosely supported on the frame 9. In other words, in the radial direction, the portions to be positioned 13 are movable relative to the bearing 12. On the other hand, with respect to the circumferential direction of the bearing 12, the movements of the portions to be positioned 13 relative to the bearing 12 are limited. Thus, the portions to be positioned 13 are positioned relative to the frame 9 with respect to the circumferential direction. When the cartridge 7 is set in the main assembly 99 of the apparatus, the outer surfaces (opposite from the contact surfaces relative to the bearing 12) of the portions to be positioned 13 are contacted to the supporting portion 63 of the cartridge provided in the main assembly 99 of the apparatus. The supporting portion 63 will be described in detail hereinafter.

Figure 12:
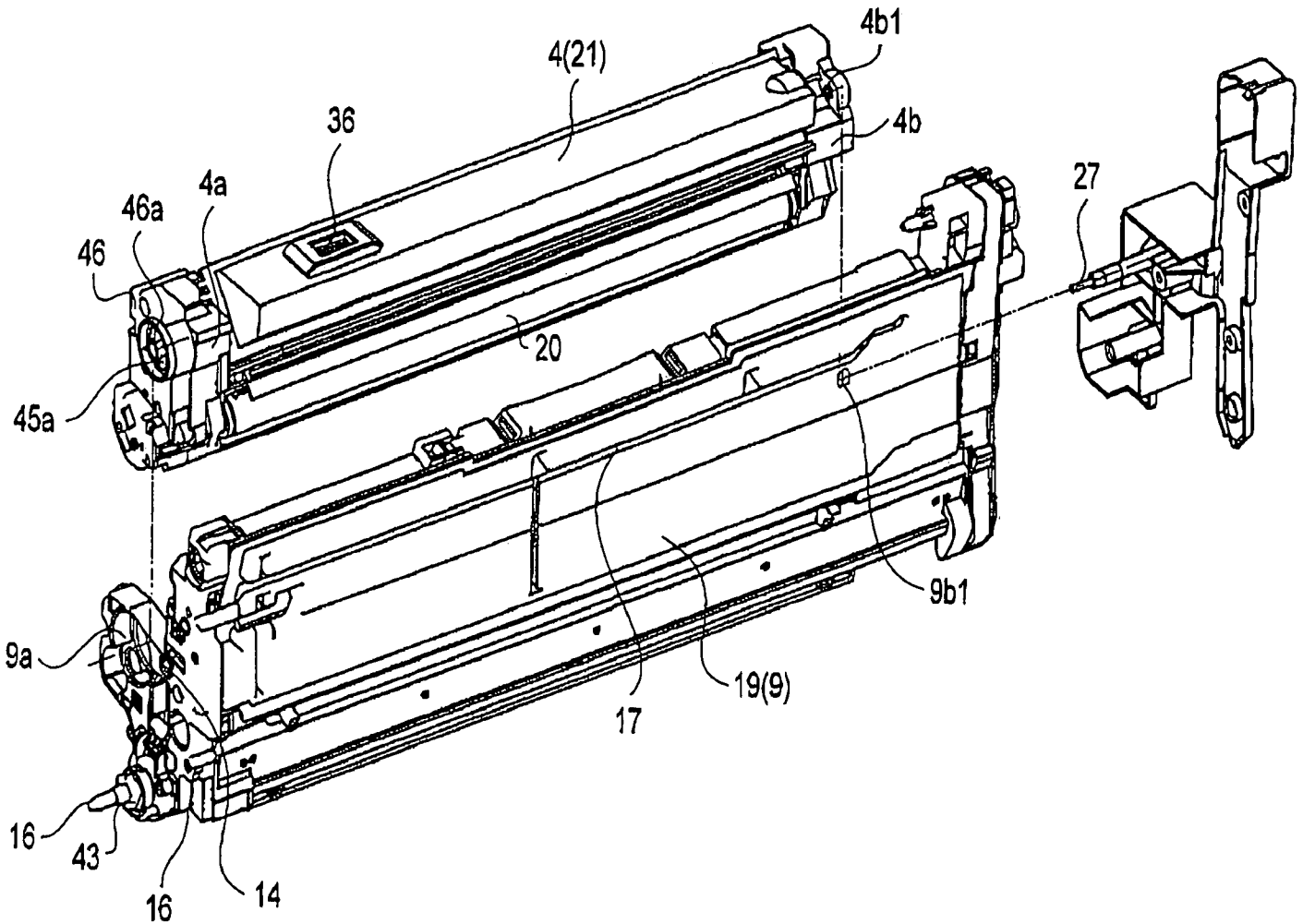
FIG. 12 is a perspective view illustrating a structure of a frame of the process cartridge.

Furthermore, a rotation stopper hole 14 shown in FIG. 12 is provided in a side surface crossing the mounting direction at a front side of the frame 9 with respect to the mounting direction. The hole 14 is engaged with a rotation stopper boss 64 (FIG. 10) provided in the main assembly 99 of the apparatus. By this, the rotation of the frame 9 relative to the main assembly 99 of the apparatus in the crossing direction is limited. In addition, the main assembly 99 of the apparatus is provided with urging means (unshown). The urging means presses the frame 9 downwardly. By doing so, the portion to be positioned 13 is urged to the supporting portion 63.

Figure 7:
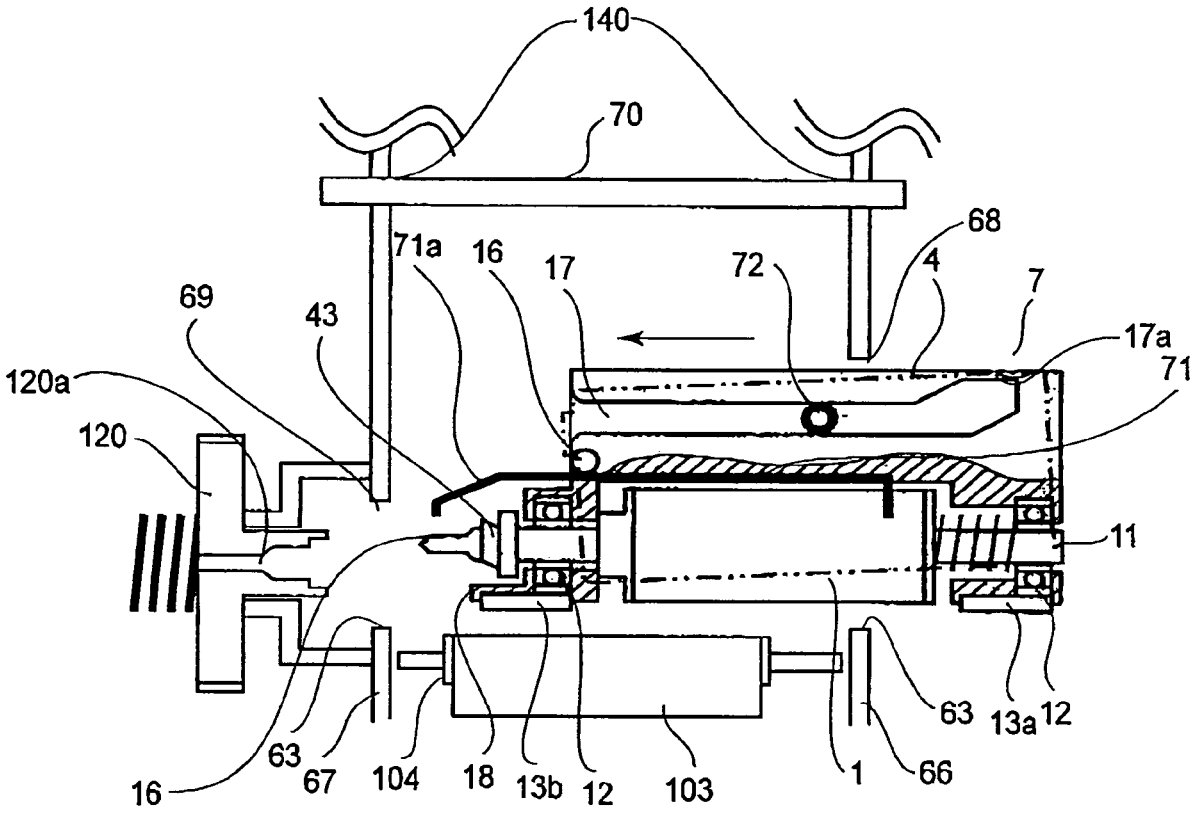
FIG. 7 is a side view of a process of insertion of the process cartridge while being guided by a guide portion.
Figure 8:
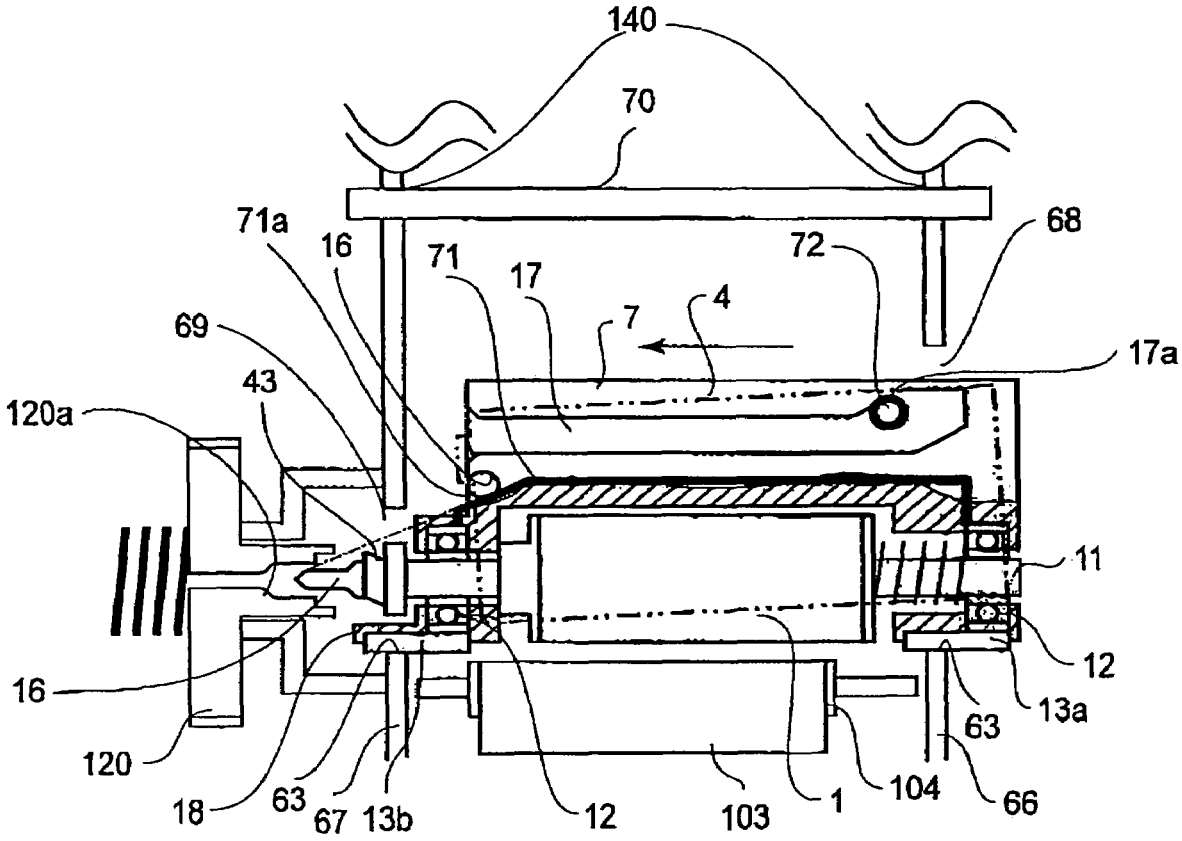
FIG. 8 is a side view showing a process of insertion of the process cartridge guided by a cartridge supporting portion.

A rear side plate 66 is provided at a rear side of the mounting portion 101 with respect to the mounting direction (FIGS. 7, 8). A front side plate 67 is provided at the front side of the mounting portion 101 with respect to the mounting direction (FIGS. 7, 8). The rear side plate 66 and the front side plate 67 are in the form of metal plates, respectively. The surfaces of the rear side plate 66 and the front side plate 67 are parallel with a plane substantially perpendicular to the mounting direction.

The rear side plate 66 is provided with a rear side opening 68. The front side plate 67 is provided with a front side opening 69.

The supporting portions 63 are disposed below the rear side opening 68 and the front side opening 69. Each of the supporting portions 63 are the same in configuration, more particularly, they are substantially V-shaped. In this embodiment, the supporting portions 63 are formed by simultaneous machining by pressing with the rear side plate 66 and the front side plate 67 overlapped. By doing so, the same positional relation and same configurations of the supporting portions 63 are assured in a plane perpendicular to the mounting direction. Thus, the supporting portions 63 at the rear side and the front side (with respect to the mounting direction) are correctly aligned in a plane substantially perpendicular to the mounting direction. The rear side plate 66 and the front side plate 67 have the supporting portions 63 for four colors, respectively.

The rear side plate 66 and the front side plate 67 have respective scanner supporting portions 140. The supporting portions 140 function to correctly position the scanner table 70. On the scanner table 70, a plurality of the scanner units 54 are positioned with high accuracy. The supporting portions 140 and the supporting portions 63 are also machined by pressing with the rear side plate 66 and the front side plate 67 overlapped, similarly to the supporting portions 63. The supporting portions 140 have the same configurations, and are disposed at the same positions with respect to the crossing direction.

In this embodiment, in order to avoid a difference in the configuration between the rear side and the front side with respect to the mounting direction, the rear side plate 66 and the front side plate 67 are overlapped and punched simultaneously This applies to both of the cartridge supporting portions 63 and the scanner supporting portions 140.

Therefore, a pair of parts is used to correctly position the four cartridges 7 and the scanner table 70. Therefore, the relative positional accuracy between the parts is within a machining tolerance for a single part. With such a positioning structure, the positional deviation and the parallelism deviation between the scanner unit 54 and the photosensitive drum 1, and the positional deviation and the parallelism deviation among the photosensitive drums 1 are minimized. As a result, the color misregistration in the image formation can be suppressed.

(Mounting Method of Process Cartridge)

A description will be provided as to a mounting method of the cartridge 7 to the main assembly 99 of the apparatus. In this embodiment, the cartridge 7 is demountably mounted to the main assembly 99 of the apparatus in the longitudinal direction of the developing roller 5 (from the front side to the rear side in FIG. 1).

Figure 6:
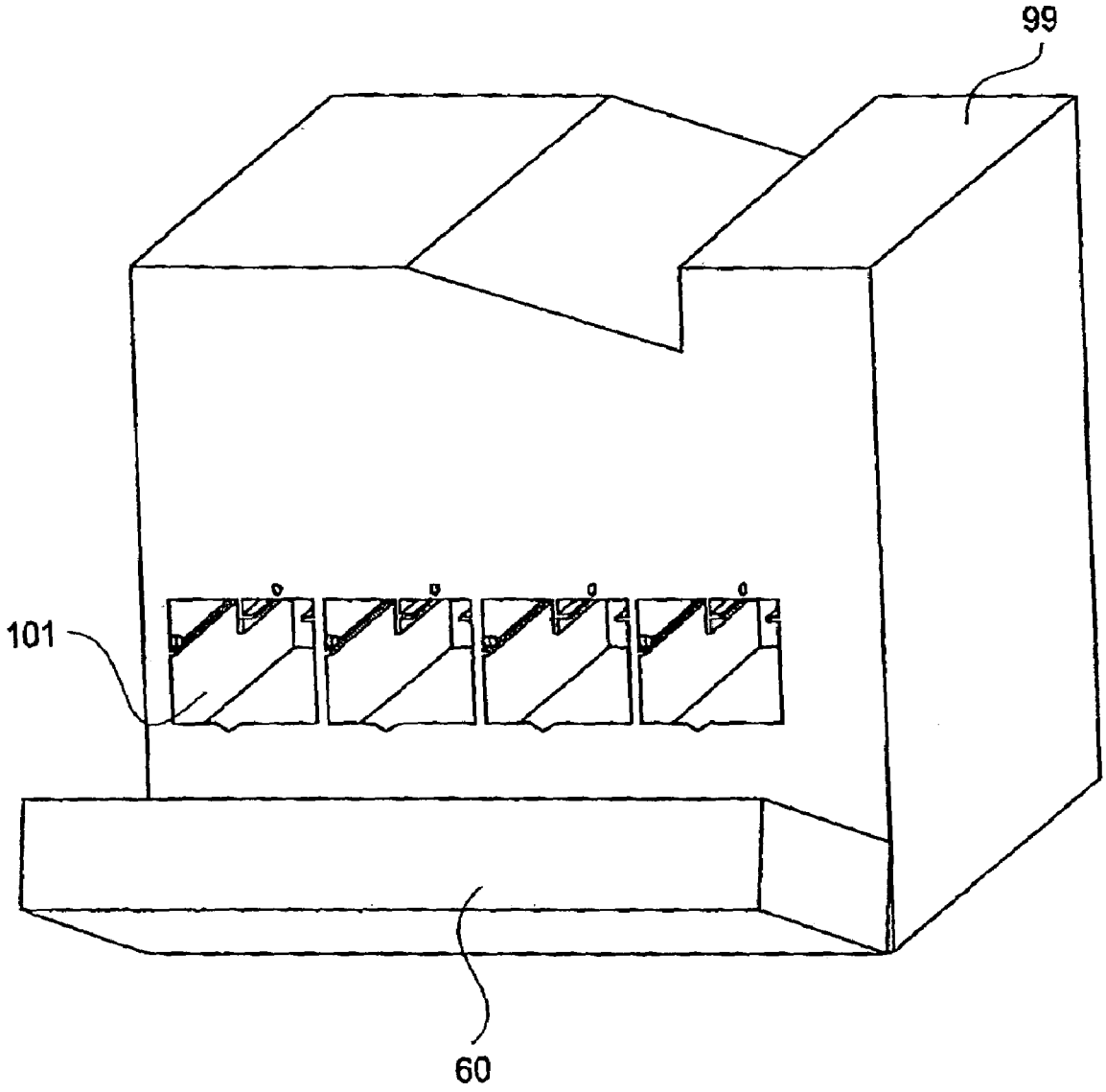
FIG. 6 is a perspective view of the electrophotographic image forming apparatus with the cover opened.

As shown in FIG. 6, an opening and closing cover 60 is provided in the front side of the main assembly 99 of the apparatus. Inside the cover 60, the mounting portion 101 is provided.

As shown in FIG. 7, the mounting portion 101 is provided with a guiding rib 71 and a guide pin 72 (guide portion) for guiding the cartridge 7. On the other hand, the drum unit 8 is provided with a projection to be guided 16 and a groove to be guided 17 (portions to be guided) for being guided by the guide portion. The rib 71 extends substantially over the entirety of the mounting portion 101 with respect to the mounting direction. The rib 71 has an inclined portion 71*a*, which inclines downwardly toward a leading side thereof with respect to the mounting direction. The pin 72 is provided at a rear side of the mounting portion 101 with respect to the mounting direction. The projection 16 is disposed at a leading side of the cartridge 7 with respect to the mounting direction The groove 17 extends substantially the entirety of the cartridge 7 with respect to the mounting direction. The groove 17 has an inclined portion 17*a* which inclines upwardly toward the tailing side with respect to the mounting direction. In the process of mounting the cartridge 7 to the mounting portion 101, the rib 71 guides the projection 16, and the pin 72 guides the groove 17.

FIG. 7-FIG. 9 show a mounting process of the cartridge 7 to the mounting portion 101.

When the cartridge 7 is mounted to the main assembly 99 of the apparatus, the projection 16 is placed on the rib 71, at first. Then, the cartridge 7 is inserted in the longitudinal direction of the cartridge 7.

As shown in FIG. 7, the attitude of the cartridge 7 is unstable in midstream. This is because in the midstream, the leading side of the cartridge 7 with respect to the mounting direction is not supported. In order to avoid unintended contact of the cartridge 7 to the transfer belt 103 in midstream of the mounting action, the cartridge 7 is guided at a position higher than the position at which the cartridge 7 is completely mounted to the mounting. With such a higher position, the cartridge 7 is advanced in the mounting direction.

Thereafter, the front side of the cartridge 7 is guided along a line inclined downwardly with respect to the mounting direction. This is accomplished by guiding the projection 16 along the inclined portion 71*a*. Thus, the front side of the cartridge 7 is guided downwardly along an inclined line. The front side of the supporting portion 63*a* is brought into contact to the outer surface of the portion to be positioned 13*a*, while the front side of the cartridge 7 is guided down inclinedly. After the portion to be positioned 13*a* is contacted to the supporting portion 63, the cartridge 7 advances in a horizontal direction while the portion to be positioned 13*a* is sliding on the supporting portion 63.

Then, the trailing side of the cartridge 7 is guided downwardly. This is accomplished by the pin 72 guiding the rear side of the cartridge 7 downwardly along the inclined portion 17*a*. Then, at the rear side of the cartridge 7 with respect to the mounting direction, the outer surface of the portion to be positioned 13*b* is brought into contact to the supporting portion 63*b*, while the rear side is guided downwardly. After the portion to be positioned 13*b* is contacted to the supporting portion 63*b*, each of the supporting portions 63*a*, 63*b* and each of the portions to be positioned 13*a*, 13*b* are in sliding relation. Then, the cartridge 7 is advanced in the horizontal direction with a horizontal attitude maintained. In this manner, the guiding function of the cartridge 7 is shifted from the rib 71 and the pin 72 to the supporting portion 63.

The longitudinal end surface 18 of the cartridge is abutted to a rear surface of the mounting portion 101. This is a completion of the mounting of the cartridge 7 to the main assembly 99 of the apparatus (FIG. 9). At this time, by the abutment between the supporting portions 63 and the portions to be positioned 13*a*, 13*b*, respectively, the drum unit 8 is positioned relative to the main assembly of the apparatus 99.

As described in the foregoing, the insertion track of the cartridge 7 is such that it is at a high position at the initial stage of insertion and in the process of insertion, and it is at a low position before completion of the mounting. With such a track employed, the respective supporting portions 63 are set in place in the rear side plate 66 and the front side plate 67. As a result, the above-described advantageous effects are provided.

(Drive Transmission Mechanism).

Referring to FIGS. 4, 10, 12, 13 and 14, a description will be made as to the drive transmission mechanism in the cartridge 7. Driving forces are transmitted from the main assembly 99 of the apparatus to the drum unit 8 and the developing unit 4, respectively in the cartridge 7.

As shown in FIG. 4, a first end cover portion 19*a* is provided at a front side of the drum unit 8 with respect to the mounting direction, and a second end cover portion 19*b* is provided at the rear side. The drum shaft 11 is rotatably supported on the first end cover portion 19*a* and the second end cover portion 19*b* through the bearing 12.

The front side of the drum shaft 11 with respect to the mounting direction (the end portion for receiving the driving force from the main assembly 99 of the apparatus) is provided with a drum coupling 43 (drum coupling member) for receiving the driving force for rotating the photosensitive drum 1 (FIG. 12). The coupling 43 is in the form of a twisted projection having a substantially triangular cross-section.

Correspondingly, the main assembly 99 of the apparatus is provided with a first main assembly coupling 120 (drum driving force transmission member) for transmitting the driving force for rotating the photosensitive drum 1 to the drum coupling member (FIG. 10). The coupling 120 is in the form of a twisted hole having a triangular cross-section.

The coupling 120 is engaged with the coupling 43 by moving the photosensitive drum 1 in the longitudinal direction. With the coupled state between them, when the coupling 120 rotates, the engagement between the coupling 120 and the coupling 43 become deeper. They are completely engaged with each other by 120° rotation at the maximum. And, the driving force is transmitted from the coupling 120 to the coupling 43. Thus, the photosensitive drum 1 is rotated.

On the other hand, the drum shaft 11 is provided with a driving gear positioning shaft at a position further leading side of the coupling 43 with respect to the mounting direction. The driving gear positioning shaft has a stepped shape. The coupling 120 is provided with a hole 120*a* at the center thereof. In the state that the cartridge 7 is set, the driving gear positioning shaft is engaged with the hole 120*a*. By doing so, the driving gear positioning shaft supports the coupling 120. With such a structure, the centers of rotation of the coupling 120 and the photosensitive drum 1 are aligned with each other. Therefore, the variation in the angle speed in a cycle of one full rotation of the photosensitive drum 1 can be suppressed. Thus, the color misregistration during image formation can be avoided.

Figure 14:
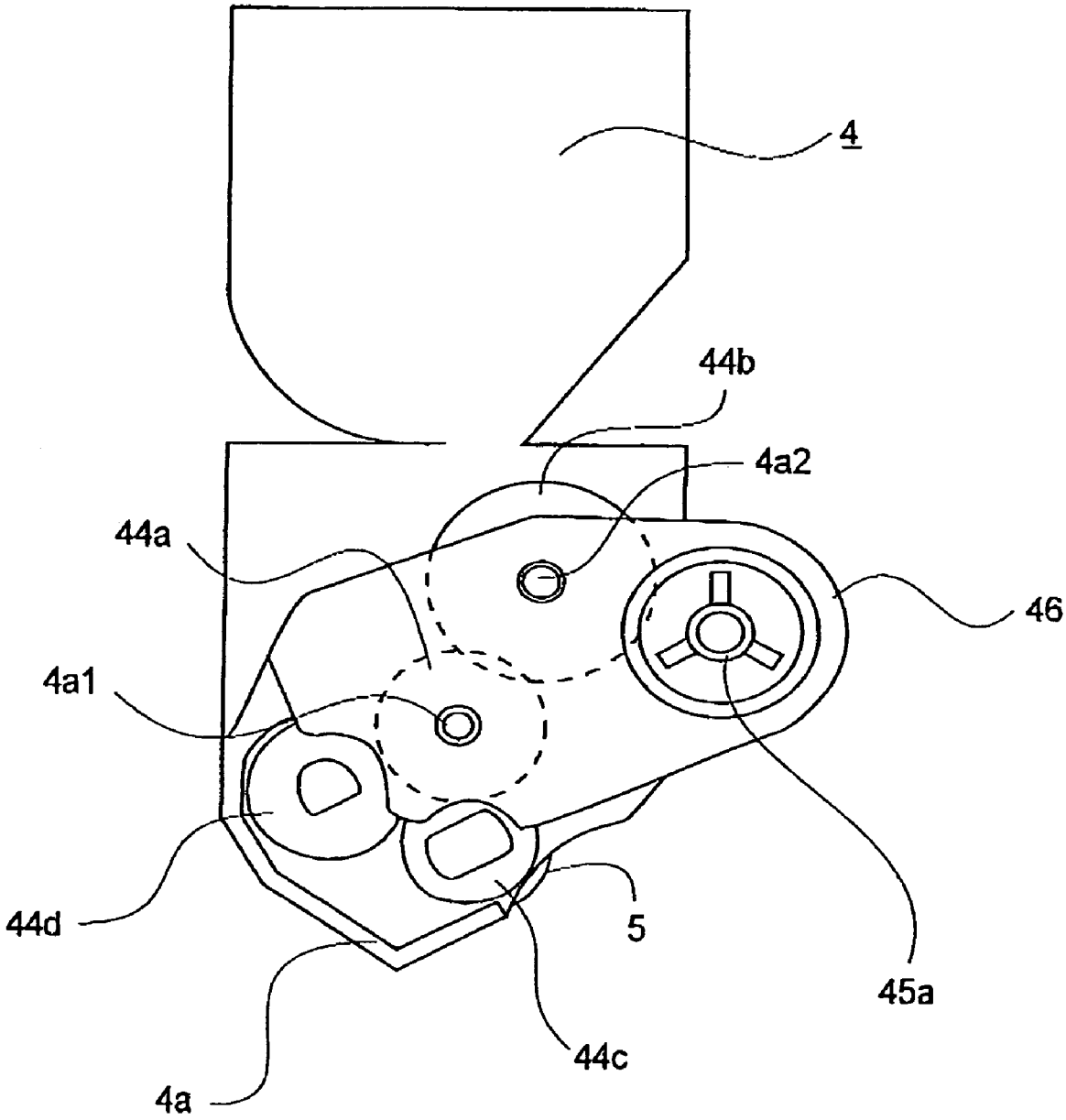
FIG. 14 is a side view of a developing unit.

As shown in FIG. 12, a front side of the developing unit 4 with respect to the mounting direction (one end of the developing unit 4 in the longitudinal direction) is provided with a first development shaft receiving portion 4*a*. The one end in the longitudinal direction is a driving side end at which the driving force is inputted from the main assembly 99 of the apparatus. A rear side of the developing unit 4 with respect to the mounting direction (the other end of the developing unit 4 in the longitudinal direction) is provided with a second development shaft receiving portion 4*b*. The other end in the longitudinal direction is a non-driving side end which is opposite from the driving side. As shown in FIG. 14, the shaft receiving portion 4*a* has supporting shafts 4*a*1, 4*a*2. Idler gears 44*a*, 44*b* (indicated in broken line in FIG. 14) are rotatably supported on the supporting shaft 4*a*1, 4*a*2, respectively.

The opposite ends of the developing roller 5 are rotatably supported by the shaft receiving portion 4*a* and the shaft receiving portion 4*b*. One longitudinal end of the developing roller 5 is provided with a developing roller driving gear 44*c* mounted thereto. The gear 44*c* is in meshing engagement with the idler gear 44*a*.

The opposite ends of the supplying roller 22 are rotatably supported by the shaft receiving portion 4*a* and the shaft receiving portion 4*b*, respectively. One longitudinal end of the supplying roller 22 is provided with a supplying roller driving gear 44*d* mounted thereto.

An end cover 46 is provided at a position frontward from the shaft receiving portion 4*a* with respect to the mounting direction. The gears 44*a*, 44*b*, 44*c* and 44*d* are disposed between the shaft receiving portion 4*a* and the cover 46 with respect to the mounting direction. The cover 46 functions to prevent the gears 44*a*-44*d* from disengaging out of the shaft receiving portion 4*a*.

The shaft receiving portion 4*a* is provided with a development driving force receiving member 45 for receiving the driving force for rotating the developing roller 5 from the main assembly 99 of the apparatus. The driving force receiving member 45 has an integral coupling portion 45*a* and a gear portion 45*b*.

Figure 13:
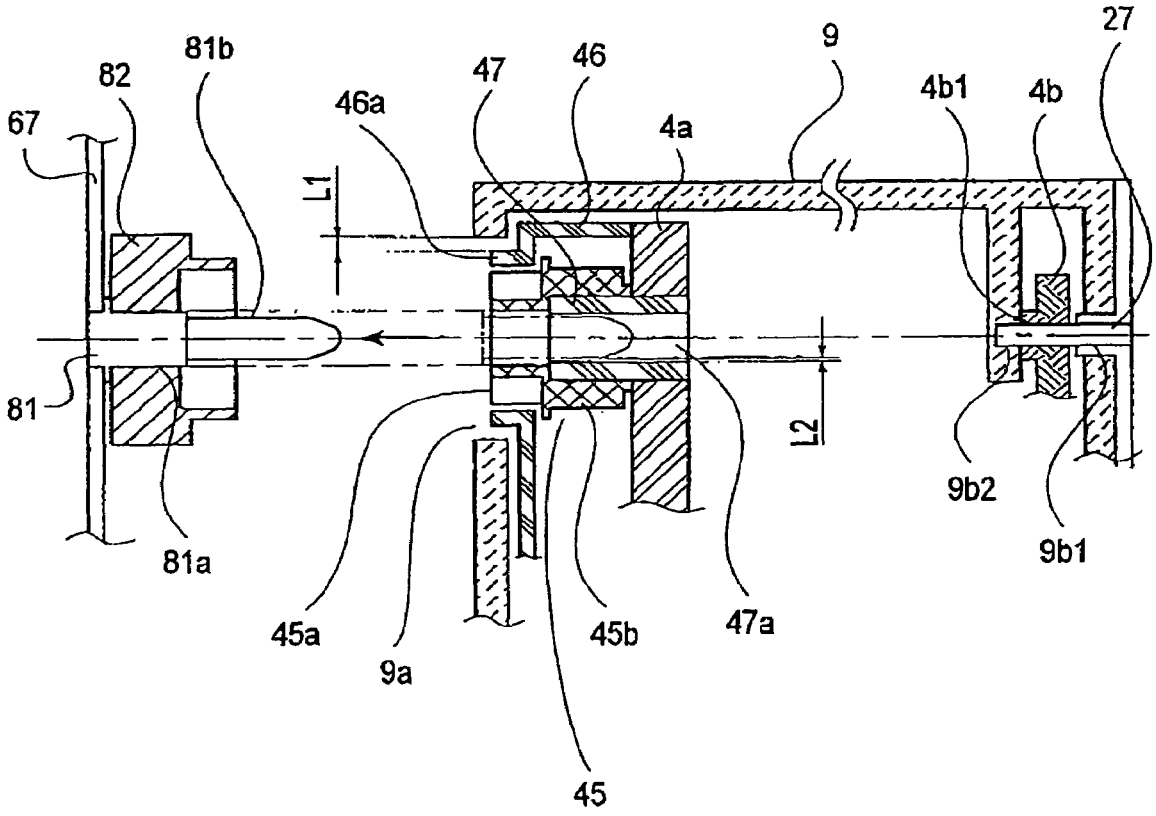
FIG. 13 is a sectional view of a connection structure between the drum unit and the developing unit and a driving structure between the developing unit and the main assembly of the electrophotographic image forming apparatus.

The shaft receiving portion 4*a* is provided with an engaging member 47. In this embodiment, the engaging member 47 is positioned and fixed on the shaft receiving portion 4*a*. On the outer surface of the engaging member 47, the driving force receiving member 45 is rotatably supported. In other words, the gear portion 45*b* is rotatably supported on the outer surface of the engaging member 47. As shown in FIG. 13, the engaging member 47 has an engaging hole 47*a* which opens toward the front side with respect to the mounting direction. In this embodiment, the engaging member 47 is cylindrical in shape. This is not inevitable, and it will suffice if there is an opening which opens toward the front side for engagement. In this embodiment, the engaging member 47 is made of a metal. Therefore, the engaging member 47 is positioned with high accuracy relative to the developing unit positioning shaft of metal which will be described hereinafter.

The developing unit positioning shaft 81 is provided in the main assembly 99 of the apparatus and functions to position the developing unit 4 relative to the main assembly 99 of the apparatus. In the state that the cartridge 7 is mounted to the main assembly 99 of the apparatus, the inner surface of the engaging hole 47*a* is rotatably engaged with the outer surface of the positioning shaft 81. The positioning shaft 81 has a circular column configuration. As described in the foregoing, the positioning shaft 81 is made of metal.

The main assembly 99 of the apparatus includes a second main assembly coupling 82 (development driving force transmission member) for transmitting to the development driving force receiving portion a driving force for rotating the developing roller (FIGS. 10, 13). The coupling 82 is rotatably supported on the outer surface of the positioning shaft 81.

In the state that the cartridge 7 is mounted to the main assembly 99 of the apparatus, the center of the engaging hole 47*a* supported on the positioning shaft 81 and the rotation axis of the driving force receiving member 45 are coaxial with each other. In this state, the coupling portion 45*a* receives a driving force from the coupling 82.

The coupling portion 45*a* has a substantially plate configuration that is twisted. The coupling 82 has a substantially plate configuration that is twisted, too. The coupling portion 45*a* is brought into engagement with the coupling 82 by movement thereof along the mounting direction. Since they have the substantially plate configuration that is twisted, the coupling 82 and the coupling portion 45*a* are engaged with each other by the mounting of the cartridge 7 by movement in the mounting direction. Thus, there is no need of providing a spring member or the like to apply a force for the engagement. In the state than they are engaged, when the coupling 82 rotates, the coupling portion 45*a* receives the driving force. As a result, the coupling portion 45*a* rotates with the gear portion 45*b*. In other words, the driving force received by the coupling portion 45*a* is received by the gear portion 45*b*. The driving force received by the gear portion 45*b* is transmitted to the gear 44*c* and to the gear 44*d* through the idler gears 44*a* and 44*b*. The driving force input to the gear portion 45*b* is branched and transmitted also to the gear train (unshown) provided to stir the developer in the developing unit 4. As a result, the screw 31, and the stirring member 32 rotate. The idler gear 44*b* is a stepped gear.

(Structure for Supporting Developing Unit).

Referring to FIGS. 10, 12, and 13, a description will be provided as to a structure for supporting the developing unit 4.

As shown in FIGS. 12 and 13, the developing unit 4 is swingably coupled to the drum unit 8 at longitudinally opposite ends thereof.

As described in the foregoing, the rear side of the developing unit 4 (non-driving side) with respect to the mounting direction is provided with a hole 4*b*1 (first portion to be supported). In this embodiment, the hole 4*b*1 penetrates the second development shaft receiving portion 4*b*.

On the other hand, the rear side of the drum unit 8 (non-driving side) with respect to the mounting direction is provided with holes 9*b*1, 9*b*2 (first supporting portion) for supporting the first portion to be supported. Thus, the holes 9*b*1, 9*b*2 are provided at the rear side of the frame 9 with respect to the mounting direction.

The holes 9*b*1, 9*b*2 and the hole 4*b*1 receive a positioning pin 27 which is in the form of a circular column. The holes 9*b*1, 9*b*2 support the hole 4*b*1 through the pin 27 to limit the movement of the frame 21 in the radial direction of the pin 27. By doing so, is the rear side of the developing unit 4 is supported to the rear side of the drum unit so as to be rotatable in the crossing direction.

On the other hand, as shown in FIG. 10, the positioning shaft 81 (second supporting portion) is projected in a direction parallel which is the mounting direction from the front side plate 67 into the inside of the main assembly 99 of the apparatus. As shown in FIG. 13, the positioning shaft 81 has a supporting portion 81*a* and a positioning portion 81*b*. The supporting portion 81*a* rotatably supports the second main assembly coupling 82 by its outer surface. As described in the foregoing, the front side of the developing unit 4 with respect to the mounting direction is provided with an engaging member 47 (second portion to be supported) for being supported by the second supporting portion. An axis of the engaging member 47 is substantially coaxial with an axis of the projection 46*a*. The positioning portion 81*b* is engaged with the hole 47*a* of the engaging member 47 when the cartridge 7 is set in the mounting portion 101. By this, the positioning portion 81*b* supports the engaging member 47 to permit rotation of the developing unit 4 in the crossing direction. Furthermore, with respect to the mounting direction, the engaging member 47 is disposed behind the projection 46. Therefore, the developing unit 4 is positioned with high precision in the main assembly 99 of the apparatus.

With respect to the mounting direction, the front side of the developing device frame 21 (driving side) is provided with an end cover 46. The end cover 46 is disposed ahead of the shaft receiving portion 4*a* with respect to the mounting direction. The end cover 46 has a projection 46*a* (third portion to be supported). The projection 46*a* is cylindrical in shape.

On the other hand, the front side of the drum frame 9 (driving side) with respect to the mounting direction is provided with a hole 9*a* (third supporting portion) for supporting the third portion to be supported.

The projection 46*a* is projected into the hole 9*a*. By doing so, when the cartridge 7 is not mounted to the main assembly 99 of the apparatus, the front side of the developing unit 4 is supported by the front side of the drum unit 8.

As shown in FIG. 13, there is a gap L1 between the projection 46*a* and the hole 9*a* in a state that said projection 46*a* and the hole 9*a* are axially aligned. In this embodiment, L1 is 0.5-1.0 mm. In other words, the hole 9*a* supports the projection 46*a* with a play in the radial direction of the driving force receiving member 45. In the state that said cartridge 7 is mounted to the mounting portion 101 (the positioning shaft 81 is inserted to the position indicated by the chain lines in FIG. 13) and that positioning portion 81*b* and the hole 47*a* are axially aligned, the gap between the positioning portion 81*b* and the hole 47*a* is L2. In this embodiment, L2 is not more than 50 μm. In other words, the positioning portion 81*b* and the hole 47*a* are engaged with each other. Thus, in this embodiment, the gap L1 is larger than the gap L2 (L1>L2). At the front side in the mounting direction, the engagement between the drum unit 8 and the developing unit 4 is deeper than the engagement between the developing unit 4 and the main assembly of the apparatus 99 in the mounted state.

As seen in the mounting direction, the coupling 82 is disposed between the projection 46*a* and the engaging member 47.

On the other hand, the other end (non-driving side) of the developing unit 4 is positioned to the drum unit 8 through the pin 27.

In this manner, in the driving side, the developing unit 4 is positioned by the main assembly 99 of the apparatus. Therefore, the developing unit 4 can be positioned with high accuracy at the driving side where the load is larger than at the non-driving side.

The axis of the engaging hole 47*a* and the axis of the hole 4*b*1 are on a line parallel to the developing roller 5.

In summary, in the state that cartridge 7 is mounted to the main assembly 99 of the apparatus, the developing unit 4 is rotatable about an axis of the pin 27 and an axis of the positioning shaft 81 in a crossing direction which crosses with the mounting direction. As described in the foregoing, the drum unit 8 is positioned relative to the main assembly 99 of the apparatus. Therefore, the developing unit 4 is movable relative to the drum unit 8. Thus, the developing roller 5 and the photosensitive drum 1 are relatively movable toward and away from each other. A pressing spring is provided between the frame 21 and the frame 9 to move the developing unit 4 to establish contact between the developing roller 5 and the photosensitive drum 1 (FIG. 2). By the elastic force of the spring, the developing roller 5 is contacted to the photosensitive drum 1 along the longitudinal direction.

As described in the foregoing, at the front side of the cartridge 7 with respect to the mounting direction, the positioning of the developing unit 4 relative to the drum unit 8 involves play. Therefore, when the cartridge 7 is mounted to the main assembly 99 of the apparatus, the front side of the developing unit 4 with respect to the mounting direction (driving side) can be inclined downwardly relative to the position of the drum unit 8. Namely, in the mounting direction, the front side of the developing unit 4 can be made lower than the position of the rear side. By doing so, the cartridge 7 is mounted to the main assembly 99 of the apparatus in the manner that the supply opening 37 projected below the container 130 and the developing unit 4 are not contacted to each other. Therefore, as shown in FIGS. 7 and 8 by the chain lines, the position of the developing unit 4 relative to the drum unit 8 during the mounting is kept inclined relative to the drum unit 8. More particularly, the front side of the developing unit 4 can be positioned below the drum unit 8 by (L1-L2). When the mounting of the cartridge 7 is completed, the front side of the developing unit 4 is positioned to the main assembly 99 of the apparatus. Therefore, the front side of the developing unit 4 is released from the support of the drum unit 8. As shown in FIG. 9 by the chain line, upon the mounting, the attitude of the developing unit 4 relative to the drum unit 8 is horizontal without inclination. In the foregoing, a description has been provided with respect to the case of the provision of the container 130, but even without the container 130, the space can be efficiently utilized if the cartridge 7 is mounted in the longitudinal direction thereof. In this embodiment, however, the advantage is further remarkable.

In this embodiment, the coupling 82 rotatable about the positioning shaft 81 transmits the driving force for rotating the developing roller 5 to the driving force receiving member 45 rotatably supported on the outer surface of the engaging member 47. By this, the amount of the positional deviation between the couplings is determined only by the coaxiality between the engaging member 47 and the positioning shaft 81.

The development driving force receiving member 45 is rotatably supported on the engaging member 47 for positioning the cartridge 7 to the main assembly 99 of the apparatus. Thus, between the engaging member 47 and the driving force receiving member 45, a plurality of parts are not provided. Therefore, the increase in errors due to tolerances in a plurality of parts can be suppressed. This can ease the dimensional accuracies required to the parts. Therefore, the yield of parts is improved, and therefore, the productivity is improved. This can reduce the manufacturing cost. In a contact developing system in which the image tends to involve a non-uniformity corresponding to the rotation of the developing roller 5, the rotation accuracy of the developing roller 5 is improved. This stabilizes the image quality.

The engaging member 47 is made of metal and is fixed on the developing unit 4. And, the positioning shaft 81 is made of metal, and is fixed in the main assembly 99 of the apparatus. Therefore, a high precision in the mutual positional relation is accomplished at the position where the driving force is transmitted from the main assembly 99 of the apparatus to the developing unit 4. Furthermore, the engaging member 47 is cylindrical in shape, and the positioning shaft 81 has a circular column configuration. Therefore, the developing unit 4 can be made stably swingable relative to the drum unit 8. In addition, the variation in the position of the developing unit 4 attributable to swing of the developing unit 4 can be suppressed.

In this embodiment, the process cartridge is a unit which is detachably mountable to the main assembly of the electrophotographic image forming apparatus and which contains at least an electrophotographic photosensitive drum, process means actable thereon and a developing roller.

According to the present invention, when the process cartridge is set in the main assembly of the electrophotographic image forming apparatus, the positioning of the cartridge relative to the main assembly of the apparatus is accurate.

Moreover, according to the present invention, when the process cartridge is set in the main assembly of the electrophotographic image forming apparatus, the driving force can be stably transmitted from the main assembly of the apparatus to the developing roller provided in the cartridge.

Additionally, when the process cartridge is set in the main assembly of the electrophotographic image forming apparatus, the load of the cartridge during the transmission of the driving force from the main assembly of the apparatus to the developing roller provided in the cartridge can be reduced.

While the invention has been described with reference to the structures disclosed herein, it is not confined to the details set forth and this application is intended to cover such modifications or changes as may come within the purpose of the improvements or the scope of the following claims. This application claims priority from Japanese Patent Application No. 091569/2005 filed Mar. 28, 2005, which is hereby incorporated by reference.

What is claimed is:

1. A process cartridge detachably mountable to a main assembly of an electrophotographic image forming apparatus, said process cartridge comprising:

an electrophotographic photosensitive drum;

a developing roller configured and positioned to develop an electrostatic latent image formed on said electrophotographic photosensitive drum, wherein said process cartridge is detachably mountable along a longitudinal direction of said developing roller;

a drum unit configured and positioned to rotatably support said electrophotographic photosensitive drum;

a first portion to be positioned relative to the main assembly of the apparatus to position said drum unit relative to the main assembly of the apparatus when said process cartridge is set in said main assembly of the apparatus, said first portion to be positioned being provided at a rear side of said drum unit with respect to a mounting direction in which said process cartridge is mounted to the main assembly of the apparatus;

a second portion to be positioned relative to the main assembly of the apparatus to position said drum unit relative to the main assembly of the apparatus when said process cartridge is set in said main assembly of the apparatus, said second portion to be positioned being provided at a front side of said drum unit with respect to the mounting direction;

a rotatable developing unit configured and positioned to rotatably support said developing roller, said developing unit being rotatable in a direction crossing the mounting direction to permit relative movement between said developing roller and said electrophotographic photosensitive drum toward and away from each other;

a first portion to be supported on a first supporting portion provided in said drum unit and being disposed at a rear side of said developing unit with respect to the mounting direction so as to permit a rotation of said developing unit in the crossing direction when said process cartridge is set in the main assembly of the apparatus;

a second portion to be supported on a second supporting portion provided in the main assembly of the apparatus so as to permit a rotation of said developing unit in the crossing direction when said process cartridge is set in the main assembly of the apparatus, said second portion to be supported being disposed at a front side of said developing unit with respect to the mounting direction; and a driving force receiving member, rotatably supported on an outer surface of said second portion to be supported, configured and positioned to receive a driving force for rotating said developing roller from a driving force transmission member provided in the main assembly of the apparatus when said process cartridge is set in the main assembly of the apparatus.

2. A process cartridge according to claim 1, wherein said second portion to be supported opens toward a leading side of said process cartridge with respect to the mounting direction.

3. A process cartridge according to claim 1, further comprising:

a third portion to be supported provided at the front side of said developing unit substantially coaxially with said second portion to be supported; and a third supporting portion, provided at the front side of said drum unit, configured and positioned to support said third portion to be supported with a play in a radial direction of said driving force receiving member, wherein said first supporting portion supports said first portion to be supported while limiting movement in the radial direction.

4. A process cartridge according to claim 1, further comprising:

a third portion to be supported provided at the front side of said developing unit substantially coaxially with said second portion to be supported; and a third supporting portion, provided at the front side of said drum unit, configured and positioned to support said third portion to be supported, wherein a gap between said second portion to be supported and said second supporting portion when axes of said second portion to be supported and said second supporting portion are aligned with each other is smaller than a gap between said third portion to be supported and said third supporting portion when axes of said third portion to be supported and said third supporting portion are aligned with each other.

5. A process cartridge according to claim 3 or 4, wherein said second portion to be supported is disposed behind said third portion to be supported with respect to the mounting direction of said process cartridge.

6. A process cartridge according to claim 3 or 4, wherein said driving force receiving member is disposed between said second portion to be supported and said third portion to be supported as seen in the mounting direction of said process cartridge.

7. A process cartridge according to claim 1, wherein said driving force receiving member is provided integrally with a coupling portion configured and positioned to receive the driving force from the driving force transmission member, and a gear portion configured and positioned to transmit the driving force received from the driving force transmission member by said coupling portion to said developing roller, said gear portion being disposed behind said coupling portion with respect to the mounting direction of said process cartridge.

8. A process cartridge according to claim 7, wherein said driving force receiving member is rotatably supported on an outer surface of said second portion to be supported by said gear portion being rotatably supported on the outer surface.

9. A process cartridge detachably mountable to a main assembly of an electrophotographic image forming apparatus, said process cartridge comprising:

an electrophotographic photosensitive drum;

a developing roller configured and positioned to develop an electrostatic latent image formed on said electrophotographic photosensitive drum, wherein said process cartridge is detachably mountable along a longitudinal direction of said developing roller;

a drum unit configured and positioned to rotatably support said electrophotographic photosensitive drum;

a first portion to be positioned relative to the main assembly of the apparatus to position said drum unit relative to the main assembly of the apparatus when said process cartridge is set in the main assembly of the apparatus, said first portion to be positioned being provided at a rear side of said drum unit with respect to a mounting direction in which said process cartridge is mounted to the main assembly of the apparatus;

a second portion to be positioned relative to the main assembly of the apparatus to position said drum unit relative to the main assembly of the apparatus when said process cartridge is set in the main assembly of the apparatus, said second portion to be positioned being provided at a front side of said drum unit with respect to the mounting direction of said process cartridge;

a rotatable developing unit configured and positioned to rotatably support said developing roller, said developing unit being rotatable in a direction crossing the mounting direction to permit relative movement between said developing roller and said electrophotographic photosensitive drum toward and away from each other;

a first portion to be supported on a first supporting portion provided in said drum unit and being disposed at a rear side of said developing unit with respect to the mounting direction so as to permit rotation of said developing unit in the crossing direction when said process cartridge is set in the main assembly of the apparatus;

a second portion to be supported on a second supporting portion provided in the main assembly of the apparatus and being disposed at a front side of said developing unit with respect to the mounting direction so as to permit rotation of said developing unit in the crossing direction when said process cartridge is set in the main assembly of the apparatus; and a driving force receiving member, provided at a front side of said developing unit with respect to the mounting direction, configured and positioned to receive a driving force for rotating said developing roller from a driving force transmission member provided in the main assembly of the apparatus when said process cartridge is set in the main assembly of the apparatus.

10. A process cartridge according to claim 9, wherein said second portion to be supported opens toward a leading side with respect to the mounting direction of said process cartridge.

11. A process cartridge according to claim 9, further comprising:

a third portion to be supported provided at the front side of said developing unit substantially coaxially with said second portion to be supported; and a third supporting portion, provided at the front side of said drum unit, configured and positioned to support said third portion to be supported with a play in a radial direction of said driving force receiving member, wherein said first supporting portion supports said first portion to be supported while limiting movement in the radial direction.

12. A process cartridge according to claim 9, further comprising:

a third portion to be supported provided at the front side of said developing unit substantially coaxially with said second portion to be supported; and a third supporting portion, provided at the front side of said drum unit, configured and positioned to support said third portion to be supported, wherein a gap between said second portion to be supported and said second supporting portion when axes of said second portion to be supported and said second supporting portion are aligned with each other is smaller than a gap between said third portion to be supported and said third supporting portion when axes of said third portion to be supported and said third supporting portion are aligned with each other.

13. A process cartridge according to claim 11 or 12, wherein said second portion to be supported is disposed behind said third portion to be supported with respect to the mounting direction of said process cartridge.

14. A process cartridge according to claim 11 or 12, wherein said driving force receiving member is disposed between said second portion to be supported and said third portion to be supported as seen in the mounting direction of said process cartridge.

15. A process cartridge according to claim 9, wherein said driving force receiving member is provided with a coupling portion configured and positioned to receive the driving force from the driving force transmission member, and a gear portion configured and positioned to transmit the driving force received from the driving force transmission member by said coupling portion to said developing roller, said gear portion being disposed behind said coupling portion with respect to the mounting direction of said process cartridge.

16. An electrophotographic image forming apparatus for forming an image on a recording material, said apparatus comprising:

i) a first positioning portion;

ii) a second positioning portion;

iii) a supporting portion; and iv) a driving force transmission member;

wherein a process cartridge is detachably mountable to a main assembly of said electrophotographic image forming apparatus, the process cartridge including an electrophotographic photosensitive drum, a developing roller configured and positioned to develop an electrostatic latent image formed on the electrophotographic photosensitive drum, wherein the process cartridge is detachably mountable along a longitudinal direction of the developing roller, a drum unit configured and positioned to rotatably support the electrophotographic photosensitive drum, a first portion to be positioned relative to said first positioning portion when the process cartridge is set in said main assembly of said apparatus, the first portion to be positioned being provided at a rear side of the drum unit with respect to a mounting direction in which the process cartridge is mounted to said main assembly of said apparatus, a second portion to be positioned relative to said second positioning portion when the process cartridge is set in said main assembly of said apparatus, the second portion to be positioned being provided at a front side of the drum unit with respect to the mounting direction, a rotatable developing unit configured and positioned to rotatably support the developing roller, the developing unit being rotatable in a direction crossing with the mounting direction to permit relative movement between the developing roller and the electrophotographic photosensitive drum toward and away from each other, a first portion to be supported on a first supporting portion provided in the drum unit and being disposed at a rear side of the developing unit with respect to the mounting direction so as to permit a rotation of the developing unit in the crossing direction when the process cartridge is set in said main assembly of said apparatus, a second portion to be supported on said supporting portion so as to permit a rotation of the developing unit in the crossing direction when the process cartridge is set in said main assembly of said apparatus, the second portion to be supported being disposed at a front side of the developing unit with respect to the mounting direction, and a driving force receiving member, rotatably supported on an outer surface of the second portion to be supported, configured and positioned to receive a driving force for rotating the developing roller from said driving force transmission member rotatably supported on an outer surface of said supporting portion when the process cartridge is set in said main assembly of said apparatus.

17. An electrophotographic image forming apparatus for forming an image on a recording material, said apparatus comprising:

i) a first positioning portion;

ii) a second positioning portion;

iii) a supporting portion; and iv) a driving force transmission member, wherein a process cartridge is detachably mountable to a main assembly of said electrophotographic image forming apparatus, the process cartridge including an electrophotographic photosensitive drum, a developing roller configured and positioned to develop an electrostatic latent image formed on the electrophotographic photosensitive drum, wherein the process cartridge is detachably mountable along a longitudinal direction of the developing roller, a drum unit configured and positioned to rotatably support electrophotographic photosensitive drum, a first portion to be positioned relative to said first positioning portion when the process cartridge is set in said main assembly of said apparatus, the first portion to be positioned being provided at a rear side of the drum unit with respect to a mounting direction in which the process cartridge is mounted to said main assembly of said apparatus, a second portion to be positioned relative to said second positioning portion when the process cartridge is set in said main assembly of said apparatus, the second portion to be positioned being provided at a front side of the drum unit with respect to the mounting direction, a rotatable developing unit configured and positioned to rotatably support the developing roller, the developing unit being rotatable in a direction crossing with the mounting direction to permit relative movement between the developing roller and the electrophotographic photosensitive drum toward and away from each other, a first portion to be supported on a first supporting portion provided in the drum unit and being disposed at a rear side of the developing unit with respect to the mounting direction so as to permit a rotation of the developing unit in the crossing direction when the process cartridge is set in said main assembly of said apparatus, a second portion to be supported on said supporting portion so as to permit a rotation of said developing unit in the crossing direction when the process cartridge is set in said main assembly of said apparatus, the second portion to be supported being disposed at a front side of the developing unit with respect to the mounting direction, and a driving force receiving member, provided at a front side of the developing unit, configured and positioned to receive a driving force for rotating the developing roller from said driving force transmission member when the process cartridge is set in said main assembly of said apparatus.

18. An apparatus according to claim 16 or 17, wherein said driving force transmission member is rotatably supported on an outer surface of said supporting portion.

19. A process cartridge detachably mountable to a main assembly of an electrophotographic image forming apparatus, said process cartridge comprising:

an electrophotographic photosensitive drum;

a developing roller configured and positioned to develop an electrostatic latent image formed on said electrophotographic photosensitive drum, wherein said process cartridge is detachably mountable along a longitudinal direction of said developing roller;

a drum unit configured and positioned to rotatably support said electrophotographic photosensitive drum;

a first portion to be positioned relative to the main assembly of the apparatus to position said drum unit relative to the main assembly of the apparatus when said process cartridge is set in said main assembly of the apparatus, said first portion to be positioned being provided at a rear side of said drum unit with respect to a mounting direction in which said process cartridge is mounted to the main assembly of the apparatus;

a second portion to be positioned relative to the main assembly of the apparatus to position said drum unit relative to the main assembly of the apparatus when said process cartridge is set in said main assembly of the apparatus, said second portion to be positioned being provided at a front side of said drum unit with respect to the mounting direction;

a rotatable developing unit configured and positioned to rotatably support said developing roller, said developing unit being rotatable in a direction crossing with the mounting direction to permit relative movement between said developing roller and said electrophotographic photosensitive drum toward and away from each other;

a first portion to be supported on a first supporting portion provided in said drum unit and being disposed at a rear side of said developing unit with respect to the mounting direction so as to permit a rotation of said developing unit in the crossing direction when said process cartridge is set in the main assembly of the apparatus; and a second portion to be supported on a second supporting portion provided in the main assembly of the apparatus so as to permit a rotation of said developing unit in the crossing direction when said process cartridge is set in the main assembly of the apparatus, said second portion to be supported being disposed at a front side of said developing unit with respect to the mounting direction.

20. A process cartridge according to claim 19, wherein said second portion to be supported opens toward a leading side of said process cartridge with respect to the mounting direction.

21. A process cartridge according to claim 19, further comprising:

a driving force receiving member, rotatably supported on an outer surface of said second portion to be supported, configured and positioned to receive a driving force for rotating said developing roller from a driving force transmission member provided in the main assembly of the apparatus when said process cartridge is set in the main assembly of the apparatus;

a third portion to be supported provided at the front side of said developing unit substantially coaxially with said second portion to be supported; and a third supporting portion, provided at the front side of said drum unit, configured and positioned to support said third portion to be supported with a play in a radial direction of said driving force receiving member, wherein said first supporting portion supports said first portion to be supported while limiting movement in the radial direction.

22. A process cartridge according to claim 19, further comprising:

a driving force receiving member, rotatably supported on an outer surface of said second portion to be supported, configured and positioned to receive a driving force for rotating said developing roller from a driving force transmission member provided in the main assembly of the apparatus when said process cartridge is set in the main assembly of the apparatus;

a third portion to be supported provided at the front side of said developing unit substantially coaxially with said second portion to be supported; and a third supporting portion, provided at the front side of said drum unit, configured and positioned to support said third portion to be supported, wherein a gap between said second portion to be supported and said second supporting portion when axes of said second portion to be supported and said second supporting portion are aligned with each other is smaller than a gap between said third portion to be supported and said third supporting portion when axes of said third portion to be supported and said third supporting portion are aligned with each other.

23. A process cartridge according to claim 21 or 22, wherein said second portion to be supported is disposed behind said third portion to be supported with respect to the mounting direction of said process cartridge.

24. A process cartridge according to claim 21 or 22, wherein said driving force receiving member is disposed between said second portion to be supported and said third portion to be supported as seen in the mounting direction of said process cartridge.

25. A process cartridge according to claim 19, further comprising:

a driving force receiving member, rotatably supported on an outer surface of said second portion to be supported, configured and positioned to receive a driving force for rotating said developing roller from a driving force transmission member provided in the main assembly of the apparatus when said process cartridge is set in the main assembly of the apparatus, wherein said driving force receiving member is provided integrally with a coupling portion configured and positioned to receive the driving force from the driving force transmission member, and a gear portion configured and positioned to transmit the driving force received from the driving force transmission member by said coupling portion to said developing roller, said gear portion being disposed behind said coupling portion with respect to the mounting direction of said process cartridge.

26. A process cartridge according to claim 25, wherein said driving force receiving member is rotatably supported on an outer surface by said gear portion being rotatably supported on an outer surface of said second portion to be supported.

* * * * *

UNITED STATES PATENT AND TRADEMARK OFFICE

CERTIFICATE OF CORRECTION

PATENT NO. : 7,310,489 B2
APPLICATION NO. : 11/094317
DATED : December 18, 2007
INVENTOR(S) : Tachio Kawai It is certified that error appears in the above-identified patent and that said Letters Patent is hereby corrected as shown below:

COLUMN 3
Line 10, “one component” should read --one-component--.
Line 34, “to” should be deleted.
Line 61, “apparatus” should read --apparatus.--.
Line 64, “to” should read --with--.

COLUMN 4
Line 56, “such” should read --such as--.

COLUMN 6
Line 63, “necessary” should read --necessary amount--.

COLUMN 9
Line 21, “direction” should read --direction.--.
Line 38, “to” should read --with--.

COLUMN 12
Line 16, “substantially” should read --substantial--.
Line 17, “substantially” should read --substantial--.
Line 21, “substantially” should read --substantial--.
Line 61, “is” (first occurrence) should be deleted.

Signed and Sealed this

Tenth Day of February, 2009

JOHN DOLL
*Acting Director of the United States Patent and Trademark Office*